US009007156B2

(12) United States Patent
Hiraiwa et al.

(10) Patent No.: US 9,007,156 B2
(45) Date of Patent: Apr. 14, 2015

(54) ELECTROMAGNETIC RELAY

(71) Applicant: Fujitsu Component Limited, Tokyo (JP)

(72) Inventors: Nobuyoshi Hiraiwa, Tokyo (JP); Yasushi Saito, Tokyo (JP); Yuki Kakoiyama, Tokyo (JP); Yanfeng Wu, Tokyo (JP)

(73) Assignee: Fujitsu Component Limited, Tokyo (JP)

( * ) Notice: Subject to any disclaimer, the term of this patent is extended or adjusted under 35 U.S.C. 154(b) by 0 days.

(21) Appl. No.: 14/095,046

(22) Filed: Dec. 3, 2013

(65) Prior Publication Data

US 2014/0159837 A1 Jun. 12, 2014

(30) Foreign Application Priority Data

Dec. 7, 2012 (JP) ..... 2012-268860

(51) Int. Cl.

| | |
|---|---|
| ***H01H 51/22*** | (2006.01) |
| ***H01H 9/44*** | (2006.01) |
| *H01H 50/42* | (2006.01) |
| *H01H 50/02* | (2006.01) |
| *H01H 50/28* | (2006.01) |

(52) U.S. Cl.

CPC ..... *H01H 9/443* (2013.01); *H01H 50/42* (2013.01); *H01H 2050/028* (2013.01); *H01H 50/28* (2013.01)

(58) Field of Classification Search

USPC ..... 335/78

See application file for complete search history.

(56) References Cited

U.S. PATENT DOCUMENTS

| | | | | | |
|---|---|---|---|---|---|
| 2,735,968 | A | * | 2/1956 | Bogue et al. | 335/275 |
| 3,800,250 | A | * | 3/1974 | Mori et al. | 335/128 |
| 4,302,742 | A | * | 11/1981 | Schedele | 335/202 |
| 4,367,448 | A | * | 1/1983 | Nishizako | 335/201 |
| 4,618,842 | A | * | 10/1986 | Nestlen et al. | 335/128 |
| 4,758,809 | A | * | 7/1988 | Bell | 335/128 |
| 4,761,627 | A | * | 8/1988 | Bell | 335/128 |
| 4,825,179 | A | * | 4/1989 | Nagamoto et al. | 335/80 |
| 4,958,137 | A | * | 9/1990 | Schroeder | 335/128 |
| 5,017,898 | A | * | 5/1991 | Kuzukawa | 335/128 |

(Continued)

FOREIGN PATENT DOCUMENTS

| | | |
|---|---|---|
| JP | 09-097550 | 4/1997 |
| JP | 2001-118451 | 4/2001 |

(Continued)

*Primary Examiner* — Shawki S Ismail
*Assistant Examiner* — Lisa Homza
(74) *Attorney, Agent, or Firm* — IPUSA, PLLC

(57) ABSTRACT

An electromagnetic relay includes a first stationary contact; a second stationary contact that is aligned with the first stationary contact in a first direction; a first movable contact that is movable toward/away from the first stationary contact in a second direction perpendicular to the first direction; a second movable contact that is movable toward/away from the second stationary contact in the second direction; and a first permanent magnet and a second permanent magnet that face each other. A first contact part, formed by the first stationary contact and the first movable contact, and a second contract part, formed by the second stationary contact and the second movable contact, are interposed between the first permanent magnet and the second permanent magnet in the first direction. The first permanent magnet and the second permanent magnet extend in a third direction, which is perpendicular to the first direction and the second direction.

11 Claims, 20 Drawing Sheets

(56) References Cited

U.S. PATENT DOCUMENTS

| | | | | | |
|---|---|---|---|---|---|
| 5,109,146 | A * | 4/1992 | Maenishi | 218/26 |
| 5,160,910 | A * | 11/1992 | Tsuji | 335/129 |
| 5,202,663 | A * | 4/1993 | Tomono et al. | 335/86 |
| 5,204,647 | A * | 4/1993 | Mitsuki et al. | 335/80 |
| 5,289,144 | A * | 2/1994 | Liao | 335/78 |
| 5,321,377 | A * | 6/1994 | Aharonian | 335/78 |
| 5,392,015 | A * | 2/1995 | Matsuoka et al. | 335/78 |
| 5,396,204 | A * | 3/1995 | Matsuoka et al. | 335/78 |
| 5,568,108 | A * | 10/1996 | Kirsch | 335/130 |
| 5,572,176 | A * | 11/1996 | Heinzl et al. | 335/129 |
| 5,680,082 | A * | 10/1997 | Stocklin | 335/128 |
| 5,757,255 | A * | 5/1998 | Noda et al. | 335/78 |
| 5,805,040 | A * | 9/1998 | Corcoran | 335/202 |
| 5,864,270 | A * | 1/1999 | Hoffman | 335/78 |
| 5,907,268 | A * | 5/1999 | Mader | 335/202 |
| 5,969,586 | A * | 10/1999 | Noda et al. | 335/83 |
| 6,034,582 | A * | 3/2000 | Fausch | 335/78 |
| 6,323,747 | B1 * | 11/2001 | Mader et al. | 335/80 |
| 6,486,760 | B2 * | 11/2002 | Miyazaki et al. | 335/78 |
| 6,606,018 | B2 * | 8/2003 | Takano et al. | 335/78 |
| 6,700,466 | B1 | 3/2004 | Yamamoto et al. | |
| 6,731,190 | B2 * | 5/2004 | Yamashita et al. | 335/78 |
| 6,903,638 | B2 * | 6/2005 | Nakamura et al. | 335/78 |
| 7,205,870 | B2 * | 4/2007 | Sanada et al. | 335/78 |
| 7,477,119 | B2 * | 1/2009 | Wu | 335/83 |
| 7,750,769 | B2 * | 7/2010 | Minowa et al. | 335/78 |
| 7,782,162 | B2 * | 8/2010 | Nishida | 335/201 |
| 7,859,371 | B2 * | 12/2010 | Takano | 335/78 |
| 7,994,884 | B2 * | 8/2011 | Kuo | 335/78 |
| 8,111,117 | B2 * | 2/2012 | Minowa et al. | 335/78 |
| 8,193,881 | B2 * | 6/2012 | Yuba et al. | 335/78 |
| 8,482,368 | B2 | 7/2013 | Sasaki et al. | |
| 2003/0231090 | A1 * | 12/2003 | Copper et al. | 335/128 |
| 2005/0057332 | A1 * | 3/2005 | Nakamura et al. | 335/128 |
| 2006/0279384 | A1 * | 12/2006 | Takayama et al. | 335/78 |
| 2009/0134962 | A1 * | 5/2009 | Nishida | 335/207 |
| 2009/0322453 | A1 * | 12/2009 | Kawaguchi et al. | 335/81 |
| 2013/0113581 | A1 * | 5/2013 | Kakimoto et al. | 335/196 |

FOREIGN PATENT DOCUMENTS

| | | |
|---|---|---|
| JP | 2005-093118 | 4/2005 |
| JP | 2007-214034 | 8/2007 |
| JP | 2009-164147 | 7/2009 |
| JP | 2011-154818 | 8/2011 |
| JP | 2011-228087 | 11/2011 |

* cited by examiner

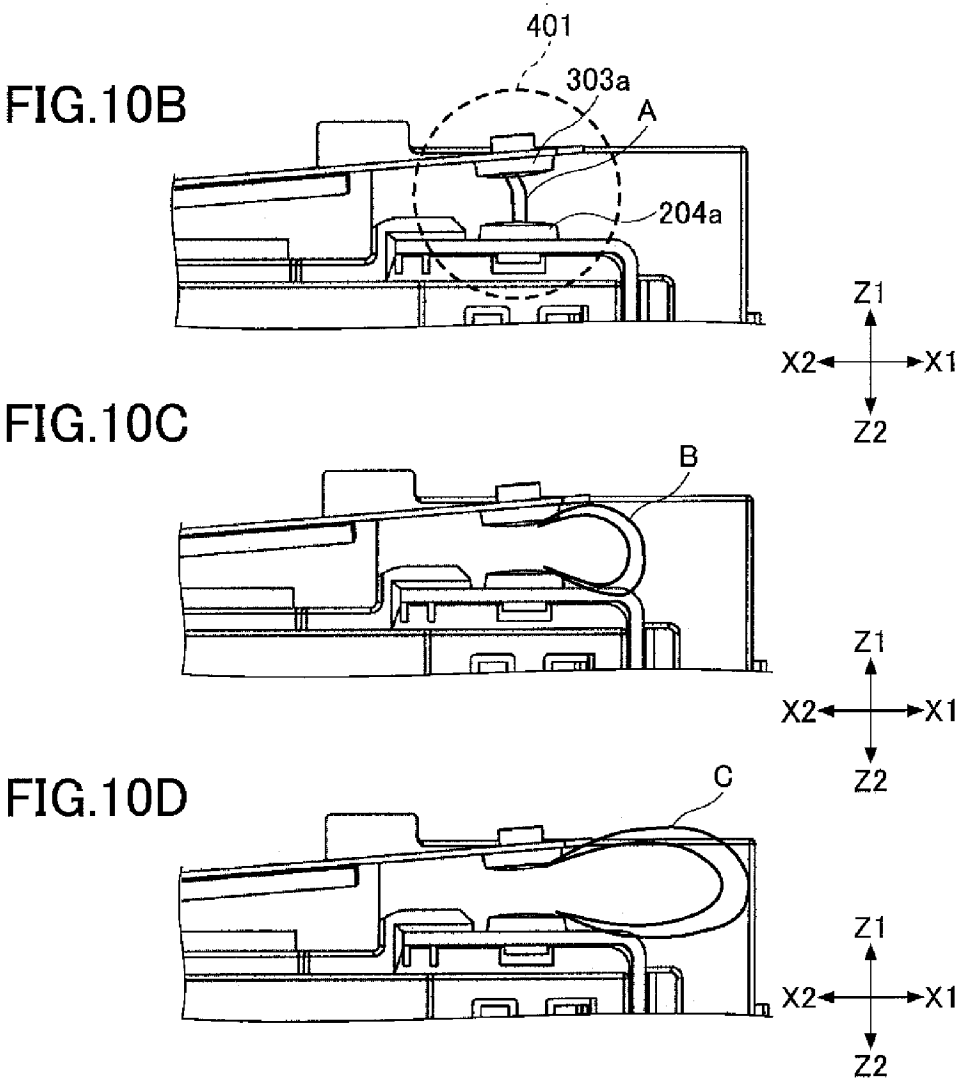
FIG.10B
FIG.10C
FIG.10D
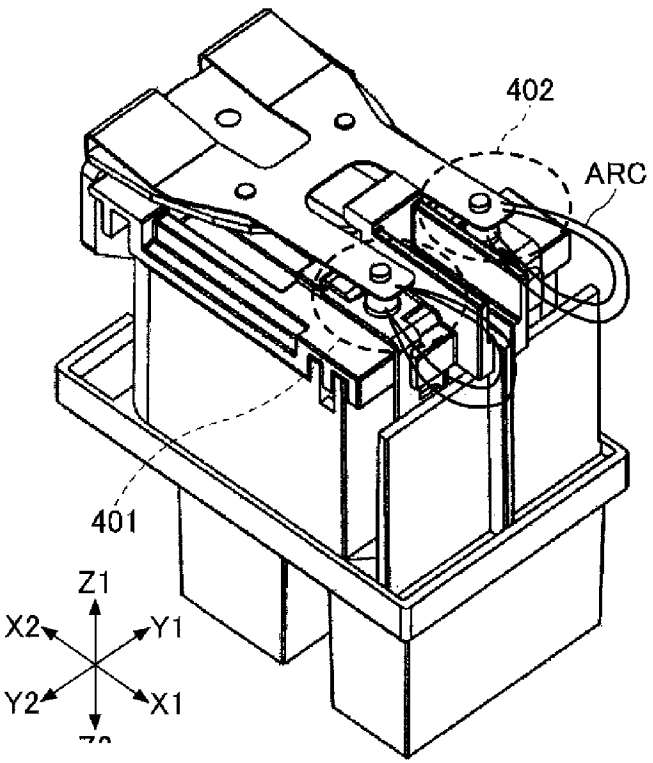
FIG.10A

ELECTROMAGNETIC RELAY

BACKGROUND OF THE INVENTION

1. Field of the Invention

The present invention relates to an electromagnetic relay.

2. Description of the Related Art

Electromagnetic relays are devices having a main contact part that breaks or allows an electric current flow between contacts, which may be opened/closed by an electromagnetic force. Because the contacts of the electromagnetic relay are opened/closed by an electromagnetic force, arcing may occur between the contacts when the contacts are opened; namely, when the electric current flow is broken. When arcing occurs, the contacts may be overheated and damaged. In some cases, the contacts may weld together as a result.

In consideration of the highly reliable breakage performance demanded in electromagnetic relays used in a high-voltage DC (direct current) circuit of an electric vehicle or a large DC system, for example, measures are desired for effectively extinguishing arcing that occurs between contacts to improve breakage performance of the electromagnetic relays and improve durability of the contacts.

Also, a surge voltage is generated when the contacts open and close in electromagnetic relays used in a DC high voltage current circuit. Accordingly, high insulation resistance (dielectric withstanding voltage) is demanded between parts such as contacts, coils and yokes of the electromagnetic relays. To increase the insulation resistance (dielectric withstanding voltage), suitable insulation distances need to be secured between the parts.

Thus, high arc extinguishing performance and high insulation between relay parts are desired characteristics in electromagnetic relays.

In this respect, for example, Japanese Laid-Open Patent Publication No. 2011-154818 (Patent Document 1), Japanese Laid-Open Patent Publication No. 2007-214034 (Patent Document 2), and Japanese Laid-Open Patent Publication No. 2011-228087 (Patent Document 3) disclose electromagnetic relays that are configured to improve arc extinguishing performance by arranging permanent magnets near contacts.

Japanese Laid-Open Patent Publication No. 2001-118451 (Patent Document 4) discloses a contact unit having a yoke arranged at a permanent magnet, which is arranged near a contact.

Japanese Laid-Open Patent Publication No. 09-097550 (Patent Document 5) discloses an electromagnetic relay that has a body block made up of a base having at least one set of terminals of a contact mechanism insert-molded therein and an insulating cover having a tunnel-like insulating wall.

Japanese Laid-Open Patent Publication No. 2009-164147 (Patent Document 6) discloses an electromagnetic relay that is configured to secure a predetermined insulation distance between an electromagnetic unit and a contact part, and increase an electromagnetic attraction force without enlarging an outer dimension of the relay.

Japanese Laid-Open Patent Publication No. 2005-093118 (Patent Document 7) discloses an electromagnetic relay that is configured to secure a required insulation interval between adjacent relay structures by providing a surrounding wall that surrounds the adjacent relay structures in a bursiform shape and a partitioning wall interposed between the relay structures.

Although the electromagnetic relays disclosed in Patent Documents 1-4 are able to improve the arc extinguishing performance by including permanent magnets, the electromagnetic strength of the permanent magnets may be inadequate in a case where a large amount of current is flown.

Also, with respect to electromagnetic relays that are arranged in a control panel or a similar device, device miniaturization is desired for purposes of reducing the device footprint. However, the device may have to be enlarged, when measures are implemented to enhance the arc extinguishing performance or insulation of electromagnetic relays, for example.

Also, in the electromagnetic relays disclosed in Patent Documents 5-7, adequate insulation may not be secured in a case where a high voltage is applied, for example.

SUMMARY OF THE INVENTION

It is a general object of the present invention to provide an electromagnetic relay that substantially solves one or more problems caused by the limitations and disadvantages of the related art.

According to one embodiment of the present invention, an electromagnetic relay includes a first stationary contact; a second stationary contact that is aligned with the first stationary contact in a first direction; a first movable contact that faces the first stationary contact and is configured to be movable toward and away from the first stationary contact in a second direction; a second movable contact that faces the second stationary contact and is configured to be movable toward and away from the second stationary contact in the second direction; a first permanent magnet; and a second permanent magnet that faces the first permanent magnet. The second direction is substantially perpendicular to the first direction. The first stationary contact and the first movable contact form a first contact part. The second stationary contact and the second movable contact form a second contact part. The first contact part and the second contact part are interposed between the first permanent magnet and the second permanent magnet with respect to the first direction. The first permanent magnet and the second permanent magnet extend in a third direction, which is substantially perpendicular to the first direction and the second direction.

According to an aspect of the present invention, a miniaturized electromagnetic relay with high arc extinguishing performance may be provided. Also, an electromagnetic relay may be provided that is capable of securing high insulation between internal parts of the electromagnetic relay.

BRIEF DESCRIPTION OF THE DRAWINGS

FIG. 10A is a perspective view of arcs generated at a first contact part and a second contact part;

FIG. 10B illustrates when an arc is generated;

FIG. 10C illustrates when the arc is extended;

FIG. 10D illustrates a state right before the arc is extinguished;

DESCRIPTION OF EMBODIMENTS

In the following, embodiments of the present invention will be described with reference to the accompanying drawings.

Figure 1A:
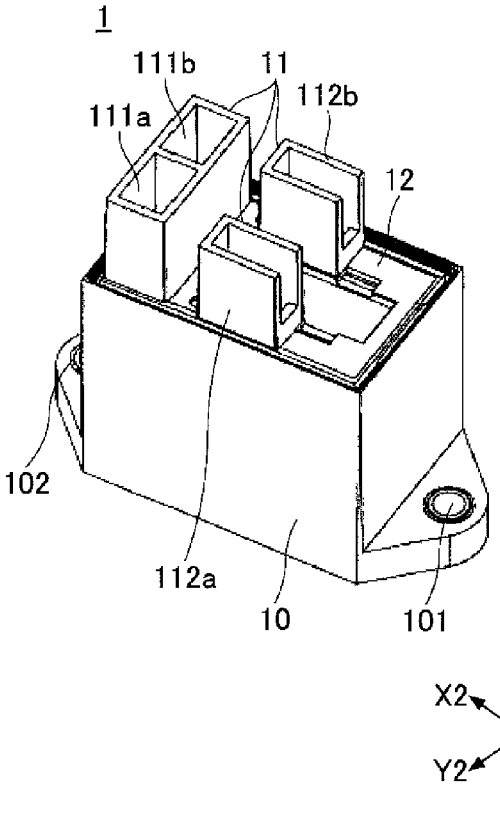
FIG. 1A is a perspective view of an electromagnetic relay according to an embodiment of the present invention viewed from a terminal side.
Figure 1B:
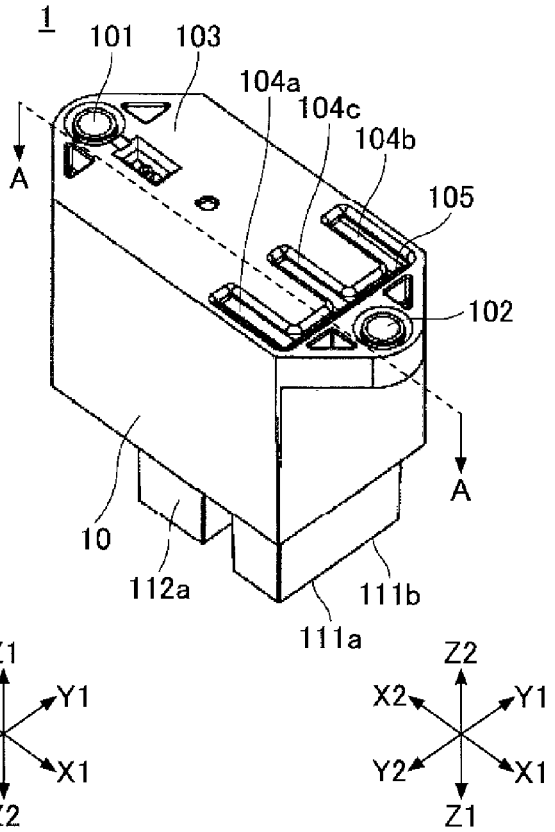
FIG. 1B is a perspective view of the electromagnetic relay viewed from a mount surface side.
Figure 1D:
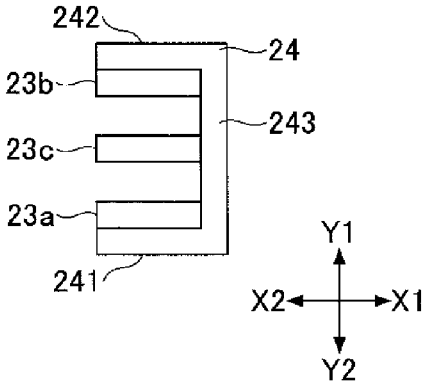
FIG. 1D is a top view of an arrangement of permanent magnets and yokes to be mounted to the electromagnetic relay.
Figure 1C:
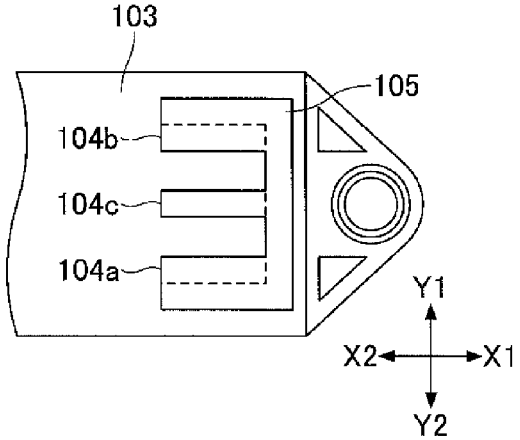
FIG. 1C is an enlarged partial view of the mount surface of the electromagnetic relay.
Figure 2:
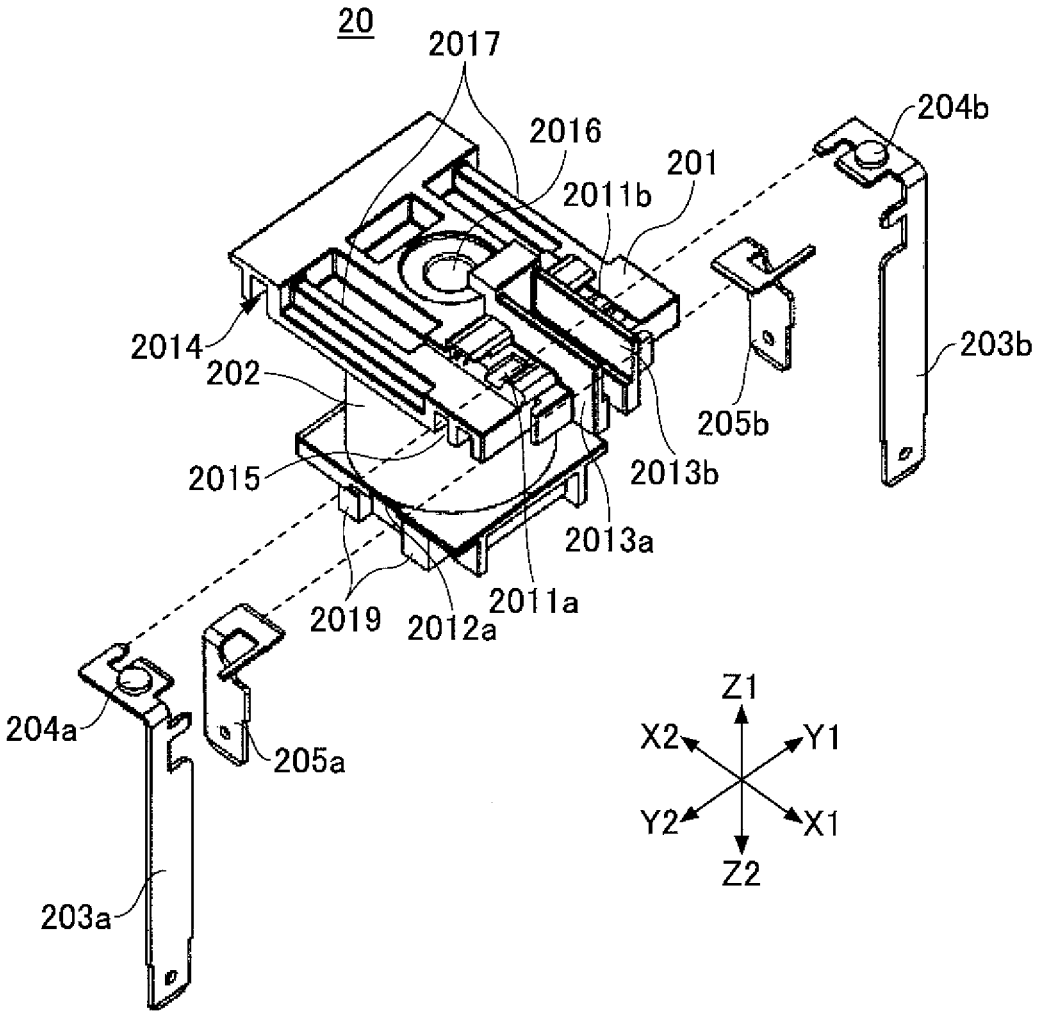
FIG. 2 illustrates a coil bobbin assembly.

FIGS. 1A-1D are external views of an electromagnetic relay 1 according to an embodiment of the present invention. FIG. 1A is a perspective view of the electromagnetic relay 1 viewed from a terminal side; FIG. 1B is a perspective view of the electromagnetic relay 1 viewed from a mount surface side; FIG. 1C is an enlarged partial view of the mount surface of the electromagnetic relay 1; and FIG. 1D is a top view of an arrangement of permanent magnets and a yoke to be mounted to the electromagnetic relay 1. FIG. 2 illustrates an exemplary configuration of a coil bobbin assembly 20.

As illustrated in FIG. 1A, the electromagnetic relay 1 of the present embodiment includes a base cover 10, a base 11, and a cover plate 12. The base cover 10, the base 11, and the cover plate 12 are made of insulating plastic material with flame-resistant properties.

The base 11 includes stationary terminal covers 111*a* and 111*b*, and coil terminal covers 112*a* and 112*b*. The stationary terminal covers 111*a* and 111*b* have openings formed in the Z1 direction side and are configured to cover stationary terminals 203*a* and 203*b*, which are described with reference to FIG. 2.

The stationary terminal covers 111*a* and 111*b* are configured to cover the stationary terminals 203*a* and 203*b*, respectively, to insulate the stationary terminals 203*a* and 203*b*.

In the case of connecting electrical cables to the stationary terminals 203*a* and 203*b*, the electrical cables are inserted into the openings of the stationary terminal covers 111*a* and 111*b* from the Z1 side toward the Z2 side to be connected to the stationary terminals 203*a* and 203*b*, respectively.

The coil terminal covers 112*a* and 112*b* are arranged to stand upright in the Z1 direction and are arranged into angular U-shaped structures that cover three sides of coil terminals 205*a* and 205*b*, which are described below with reference to FIG. 2. The coil terminal covers 112*a* and 112*b* are configured to insulate the coil terminals 205*a* and 205*b* from the stationary coils 203*a* and 203*b*. Accordingly, in the present embodiment, the sides of the coil terminal covers 112*a* and 112*b* toward the X1 direction that are positioned farthest from the stationary terminal covers 111*a* and 111*b* are left open.

The cover plate 12 is bonded to the base 11 and is configured to cover internal parts of the electromagnetic relay 1. Note that the cover plate 12 is a surface to which a terminal and a coil terminal are mounted.

As illustrated in FIG. 1B, the base cover 10 includes mount holes 101 and 102, a mount surface 103, permanent magnet mount parts 104*a*-104*c*, and a yoke mount part 105. The mount surface 103 corresponds to a surface of the electromagnetic relay 1 that is mounted to a component mount surface of a control panel or a similar device, for example. The electromagnetic relay 1 may be fixed to the component mount surface of the control panel with screws using the mount holes 101 and 102, for example. In the present embodiment, when the mount surface 103 of the electromagnetic relay 1 is mounted to the component mount surface of the control panel, the stationary terminal covers 111*a* and 111*b*, the coil terminal covers 112*a* and 112*b* are arranged to be disposed at the top side corresponding to the upper side of FIG. 1A. By mounting the electromagnetic relay 1 to the control panel in this manner, electric cables may be connected to the stationary terminals 203*a* and 203*b* and the coil terminals 205*a* and 205*b* from the top side (i.e., the side opposite the mount surface 103) so that ease of working with the electric cables may not be substantially compromised even when other device components are mounted close to the electromagnetic relay 1.

FIG. 1C illustrates a portion of the mount surface 103 where the permanent magnet mount parts 104*a*-104*c* and the yoke mount part 105 are arranged. FIG. 1D illustrates an arrangement of permanent magnets 23*a*-23*c* to be respectively mounted to the permanent magnet mount parts 104*a*-104*c*, and a yoke 24 to be mounted to the yoke mount part 105. The permanent magnets 23*a*-23*c* and the yoke 24 are arranged to be in contact with each other as illustrated in FIG. 1D when they are mounted to the permanent magnet mount parts 104*a*-104*c* and the yoke mount part 105 illustrated in FIG. 1C. Note that dotted lines in FIG. 1C illustrate the locations of a boundary between the permanent magnet 104*a* and the yoke 24 and a boundary between the permanent magnet 104*b* and the yoke when the permanent magnets 23*a*-23*c* and the yoke 24 are mounted. In the present embodiment, the permanent magnet mount parts 104*a*-104*c* and the yoke mount part 105 form an open space.

In FIG. 1D, the permanent magnets 23*a*-23*c* are arranged into rectangular shapes with their longer sides extending in the X1-X2 directions. Note that the X1-X2 directions correspond to arc extending directions as described below. The permanent magnets 23*a*-23*c* may be made of alnico magnets, ferrite magnets, rare earth magnets, or some other type of magnetic material, for example. Also, the permanent magnets 23*a*-23*c* may be arranged in different numbers and different polarities. For example, instead of arranging the three permanent magnets 23*a*-23*c*, two permanent magnets 23*a* and 23*b* may be arranged at the permanent magnet mount parts 104*a* and 104*b* with their respective N poles facing each other.

The yoke 24 is arranged to strengthen the magnetic field generated by the permanent magnets 23*a*-23*c*. The yoke 24 may be a magnetic body made of a magnetic material having a predetermined magnetic permeability, for example. The yoke 24 may be formed by pressing the magnetic material such as a magnetic steel plate into an angular U-shape having two opposing sides and another side connecting the two opposing sides. In the example illustrated in FIG. 1D, the yoke 24 includes a first side 241 that comes into contact with the permanent magnet 23*a*, a second side 242 that comes into contact with the permanent magnet 23*b*, and a third side 243 that connects the first side 241 and the second side 242. In FIG. 1D, the yoke 24 comes into contact with the permanent magnet 23*c* at the third side 243. Also, the length of the permanent magnet 23*a* in the X1-X2 directions is adjusted so that the X2 direction side face of the permanent magnet 23*a* and the X2 direction side face of the first side 241 may be substantially coplanar when the X1 direction side face of the permanent magnet 23*a* comes into contact with the third side 243. Similarly, the length of the permanent magnet 23*b* in the X1-X2 directions is adjusted so that the X2 direction side face of the permanent magnet 23*b* and the X2 direction side face of the second side 242 may be substantially coplanar when the X1 direction side face of the permanent magnet 23*b* comes into contact with the third side 243.

Note that in the embodiment illustrated in FIG. 1D, the yoke 24 has the first side 241 and the second side 242 opposing each other and meeting the third side 243 at right angles. However, in other alternative embodiments, the first through third sides 241-243 may be slightly curved, for example. Also, the third side 243 may be curved to form an arc-shape, for example.

In the following, the electromagnetic relay 1 is described in greater detail with reference to FIGS. 2-5.

In FIG. 2, the coil bobbin assembly 20 includes a bobbin 201, a coil 202, the stationary terminals 203*a* and 203*b*, stationary contacts 204*a* and 204*b*, and the coil terminals 205*a* and 205*b*.

The bobbin 201 includes stationary terminal mount parts 2011*a* and 2011*b* to which the stationary terminals 203*a* and 203*b* are respectively mounted, and coil terminal mount parts 2012*a* and 2012*b* to which the coil terminals 205*a* and 205*b* are respectively mounted. The coil 202 generates an electromagnetic force for driving movable contacts (described below) by flowing electrical currents to the coil terminals 205*a* and 205*b*.

The stationary terminals 203*a* and 203*b* are press-fit to the stationary terminal mount parts 2011*a* and 2011*b* of the bobbin 201 from the Y2 side and the Y1 side, respectively. Electrical cables may be connected to the stationary terminals 203*a* and 203*b* and the coil terminals 205*a* and 205*b* using tab terminals (not shown) or solder, for example.

The stationary terminals 203*a* and 203*b* respectively have the stationary contacts 204*a* and 204*b* mounted thereon. The stationary contacts 204*a* and 204*b* are respectively arranged at positions facing movable contacts 303*a* and 303*b* (described below with reference to FIG. 4) that are configured to be movable toward/away from the stationary contacts 204*a* and 204*b*. A pair of the stationary contact 204*a* and the movable contact 303*a* and a pair of the stationary contact 204*b* and the movable contact 303*b* form contact parts that open/close to break/allow an electric current flow. The stationary contacts 204*a* and 204*b* and the movable contacts 303*a* and 303*b* may be made of silver tin oxide, silver nickel, or silver tungsten, for example.

The bobbin 201 includes inter-stator insulation walls 2013*a* and 2013*b* arranged between the stationary contacts 204*a* and 204*b*. The bobbin 201 also includes labyrinths 2014 and 2015, a core mount part 2016, and labyrinths 2017 and 2019.

The inter-stator insulation walls 2013*a* and 2013*b* provide insulation between the stationary contacts 204*a* and 204*b*. The permanent magnet mount part 104*c* illustrated in FIGS. 1B and 1C may be arranged into a space formed between the inter-stator insulation walls 2013*a* and 2013*b*, and the permanent magnet 23*c* illustrated in FIG. 1D may be arranged between the stationary contacts 204*a* and 204*b*. In this way, the inter-stator insulation walls 2013*a* and 2013*b* may also provide insulation between the permanent magnet 23*c* and the stationary contacts 204*a* and 204*b*.

Figure 3:
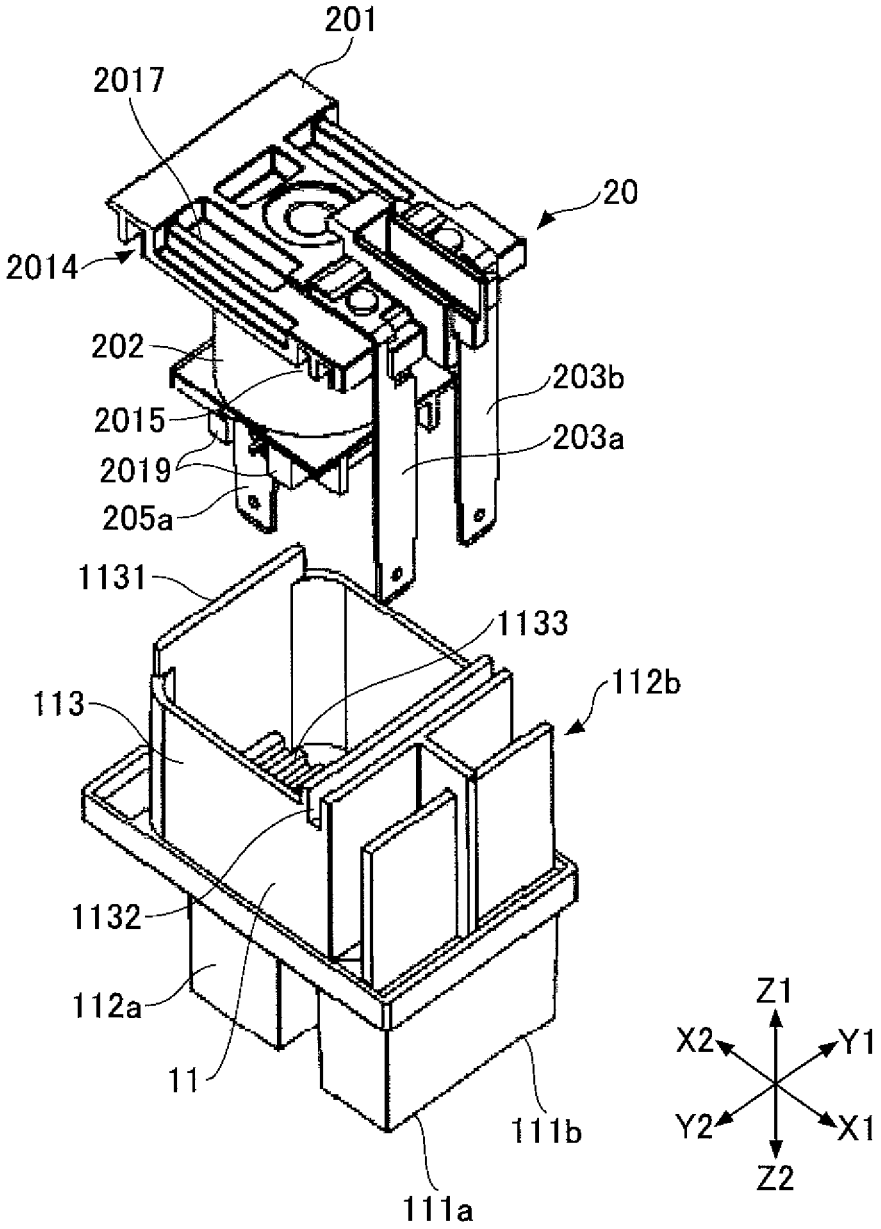
FIG. 3 illustrates an exemplary manner of assembling together the coil bobbin assembly and a base.

FIG. 3 illustrates an exemplary manner of assembling together the coil bobbin assembly 20 and the base 11. In FIG. 3, the coil bobbin assembly 20 is inserted into the base 11 from the Z1 side toward the Z2 side.

The base 11 includes the stationary terminal covers 111*a* and 111*b* and the coil terminal covers 112*a* and 112*b* as described above with reference to FIG. 1A. The stationary terminals 203*a* and 203*b* are inserted into the stationary terminal covers 111*a* and 111*b*, respectively, and the coil terminals 205*a* and 205*b* are inserted into the coil terminal covers 112*a* and 112*b*, respectively.

The base 11 further includes a coil accommodating part 113. The coil accommodating part 113 has an opening for accommodating the coil 202 of the coil bobbin assembly 20. The coil accommodating part 113 includes a barrier 1131 arranged at the X2 side of the opening and a labyrinth 1132 arranged at the X1 side of the opening. The labyrinth 2014 is arranged at the X2 side of the bobbin 201, and the labyrinth 2015 is arranged at the X1 side of the bobbin 201. Note that "labyrinth" refers to a continuous concave-convex shaped part. When the coil bobbin assembly 20 and the base 11 are assembled together, the labyrinth 2014 engages the barrier 1131 to form a concave-convex structure, and the labyrinth 2015 engages the labyrinth 1132 to form a concave-convex structure. Also, a labyrinth 1133 arranged at the internal bottom face of the coil accommodating part 113 engages the labyrinth 2019 arranged at the bottom of the bobbin 201 to form a concave-convex structure. Note that "concave-convex structure" refers to a structure having a concave-convex portion formed by assembling together components including a labyrinth so that the concave-convex structure may be capable of increasing a creepage distance and/or a clearance distance as described below.

Figure 4:
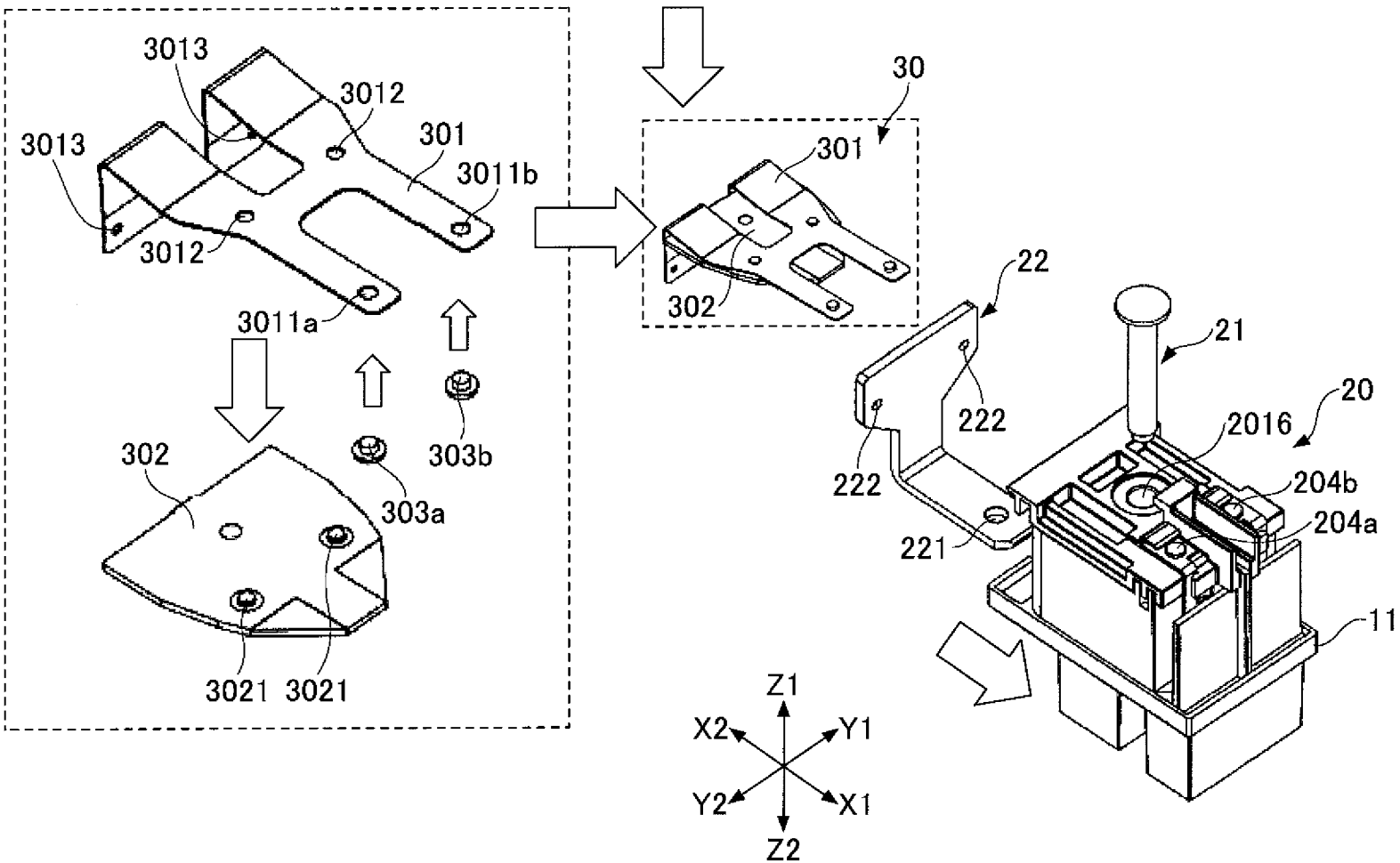
FIG. 4 illustrates an exemplary movable part assembly to be mounted to the coil bobbin assembly.

FIG. 4 illustrates an exemplary movable part assembly 30 to be mounted to the coil bobbin assembly 20. In FIG. 4, the base 11 and the coil bobbin assembly 20 illustrated in FIG. 3 are assembled together. An electromagnetic yoke 22, which is arranged at the X2 side of the coil bobbin assembly 20, includes a core mount hole 221 and a movable spring mount hole 222. The movable part assembly 30 includes a movable spring 301, an armature 302, and movable contacts 303*a* and 303*b*. The movable spring 301 includes movable contact mount parts 3011*a* and 3011*b*, an armature mount part 3012, and a yoke mount part 3013. The armature 302 includes a movable spring mount part 3021.

In the following, a method of assembling the movable part assembly 30 is described. The movable contacts 303*a* and 303*b* are mounted to the movable contact mount parts 3011*a* and 3011*b*, respectively. The movable spring 301 and the armature 302 are assembled together by having the movable spring mount part 3021 engage the armature mount part 3012 to form the movable part assembly 30. Further, the movable part assembly 30 is integrated with the electromagnetic yoke 22 by having the yoke mount part 3013 engage the movable spring mount part 222. The electromagnetic yoke 22 is inserted into the base 11 in the X1 direction so that the movable contacts 303*a* and 303*b* and the stationary contacts 204*a* and 204*b* face each other in the Z1-Z2 directions. Also, a core 21 is inserted through the core mount part 2016 so that its tip portion may be inserted into the core mount hole 221 of the electromagnetic yoke 22, which is inserted into the base 11.

By assembling the core 21, the electromagnetic yoke 22, and the movable part assembly 30 in the above-described manner, the core 21, the electromagnetic yoke 22, and the movable part assembly 30 may be integrated to form a magnetic circuit and may be electrically connected. In this case, the core 21 and the electromagnetic yoke 22 will have the same electric potential as that of the movable contacts 303*a* and 303*b* corresponding to contacts of the electromagnetic relay 1. Accordingly, the core 21 and the electromagnetic yoke 22 have to be insulated from components such as the coil 202 within the electromagnetic relay 1.

Figure 5:
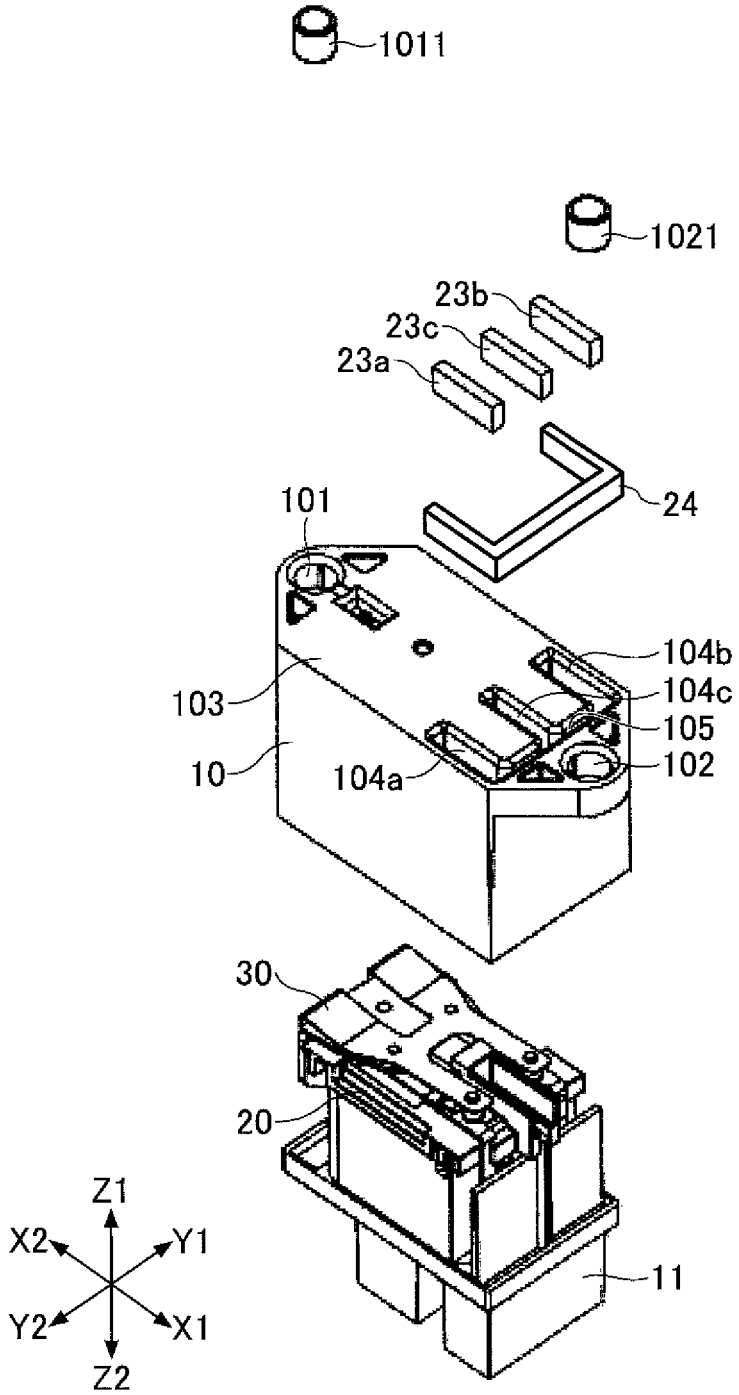
FIG. 5 illustrates an exemplary manner of assembling a base cover.

FIG. 5 illustrates an exemplary manner of assembling the base cover 10. As described above with reference to FIGS. 1B and 1C, the base cover 10 includes the mount holes 101 and 102, the permanent magnet mount parts 104*a*-104*c*, and the yoke mount part 105. In FIG. 5, the permanent magnets 23*a*-23*c* are mounted to the permanent magnet mount parts 104*a*-104*c*, respectively. Also, the yoke 24 is mounted to the yoke mount part 105. Further, collars 1011 and 1021 are mounted to the mount holes 101 and 102, respectively.

In the following, a method of extinguishing an arc generated at the electromagnetic relay 1 is described with reference to FIGS. 6A-10B.

Figure 6B:
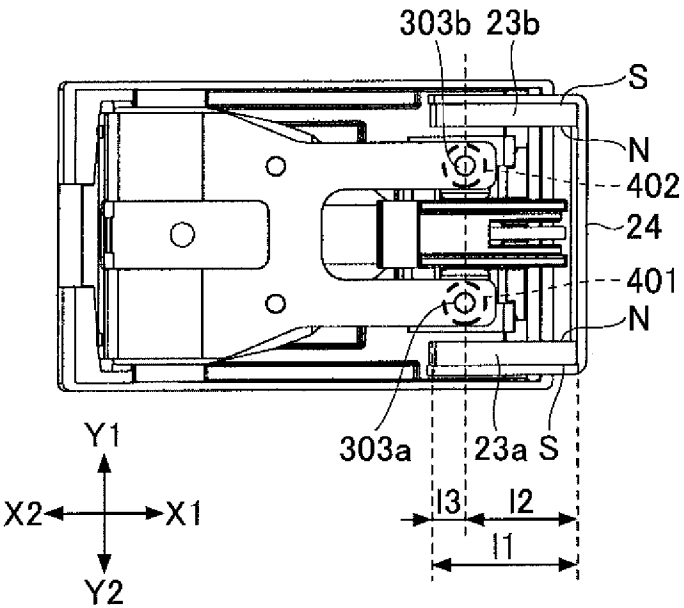
FIGS. 6A and 6B are respectively a perspective view and a top view of an exemplary arrangement of permanent magnets and a yoke of the electromagnetic relay.
Figure 6A:
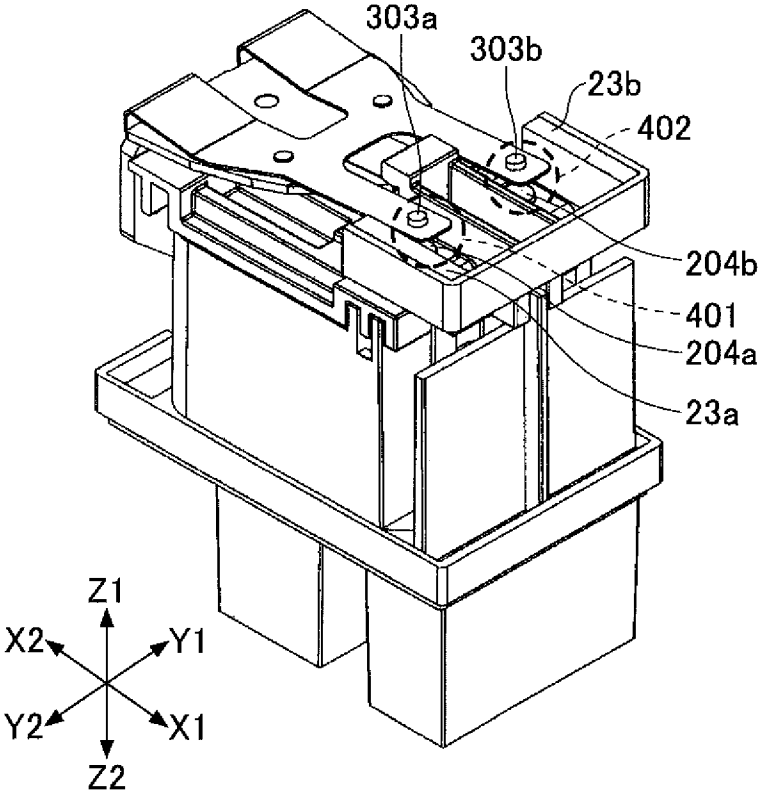

FIG. 6A is a perspective view and FIG. 6B is a top view of an exemplary arrangement of the permanent magnets 23*a* and 23*b* and the yoke 24 of the electromagnetic relay 1. Note that in the example illustrated in FIGS. 6A and 6B, the permanent magnets 23*a* and 23*b* are used but the permanent magnet 23*c* is not used. Also, in FIGS. 6A and 6B, illustrations of the permanent magnet mount parts 104*a*-104*c* and the yoke mount part 105 of the mount surface 103 shown in FIG. 5 are omitted for the sake of clearly illustrating the arrangement of the permanent magnets 23*a* and 23*b* and the yoke 24.

Referring to FIG. 6A, the movable contact 303*a* faces the stationary contact 204*a* and is configured to be movable toward/away from the stationary contact 204*a* in the Z1-Z2 directions. The movable contact 303*a* and the stationary contact 204*a* arranged in this manner form a first contact part 401. Also, the movable contact 303*b* faces the stationary contact 204*b* and is configured to be movable toward/away from the stationary contact 204*b* in the Z1-Z2 directions. The movable contact 303*b* and the stationary contact 204*b* arranged in this manner form a second contact part 402. The permanent magnets 23*a* and 23*b* are arranged to face each other in the Y1-Y2 directions. The first contact part 401 and the second contact part 402 are interposed between the permanent magnets 23*a* and 23*b*. The permanent magnet 23*a* is arranged to have its Y2 side face in contact with the yoke 24, and the permanent magnet 23*b* is arranged to have its Y1 side face in contact with the yoke 24.

Referring to FIG. 6B, the permanent magnets 23*a* and 23*b* face each other in the Y1-Y2 directions and are arranged to be parallel in the X1-X2 directions with their N poles facing toward the inner side and their S poles facing toward the outer side. The first contact part 401 and the second contact part 402 are interposed between the permanent magnets 23*a* and 23*b* with respect to the Y1-Y2 directions.

In FIG. 6B, "11" represents the length of the permanent magnet 23*a* and the length of the permanent magnet 23*b* in the X1-X2 directions; "12" represents the length from the center of the first contact part 401 to the X1 side end of the permanent magnets 23*a* and the length from the center of the second contact part 402 to the X1 side end of the permanent magnet 23*b*; and "13" represents the length from the center of the first contact part 401 to the X2 side end of the permanent magnet 23*a* and the length from the center of the second contact part 402 to the X2 side end of the permanent magnet 23*b*. That is, 11=12+13. In FIG. 6B, the length 12 is arranged to be longer than the length 13. That is, the first contact part 401 and the second contact part 402 are interposed between the permanent magnets 23*a* and 23*b* in the Y1-Y2 directions, and the permanent magnets 23*a* and 23*b* are arranged to extend longer in the X1 direction by the distance 12 compared to the distance 13 in the X2 direction from the centers of the first contact 401 and the second contact 401, respectively. The extending direction of the distance 12 corresponds to an arc extending direction for securing an arc extending space as described below with reference to FIG. 7.

Figure 7:
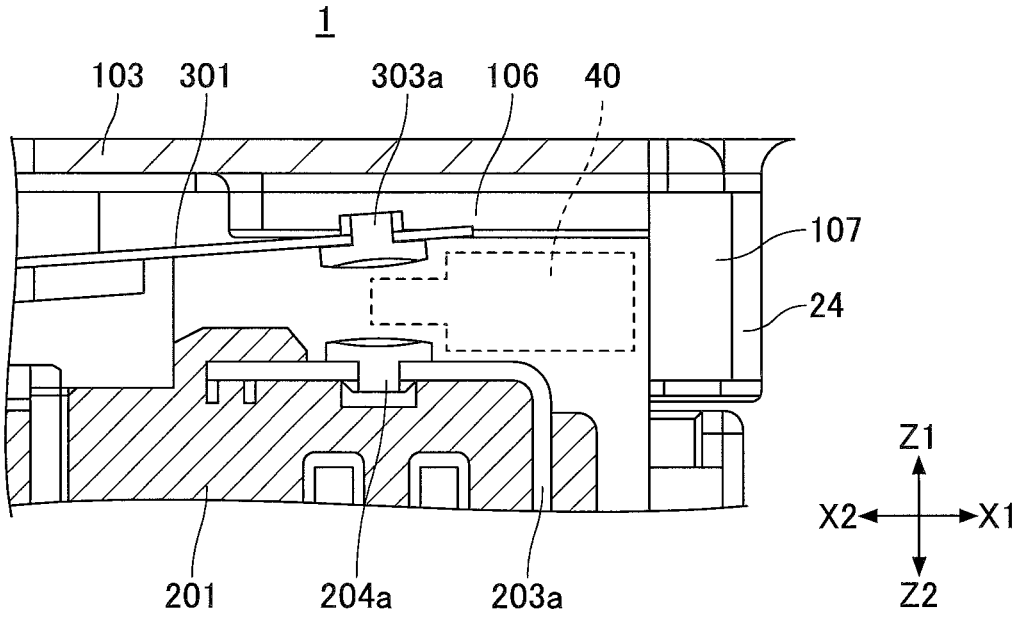
FIG. 7 is an enlarged partial cross-sectional view of the electromagnetic relay across line A-A of FIG. 1B.

In the following, an exemplary arc extending space is described with reference to FIG. 7. FIG. 7 is an enlarged partial cross-sectional view of the electromagnetic relay 1 across line A-A of FIG. 1B as viewed from the Y2 side. FIG. 7 illustrates the first contact part 401 that is formed by the pair of the stationary contact 204*a* and the movable contact 303*a*. As illustrated in FIG. 7, the stationary contact 204*a* is attached to the stationary terminal 203*a*, and the stationary terminal 203*a* is fixed to the bobbin 201. The movable contact 303*a* is attached to the movable spring 301 and is urged toward the Z1 direction by the movable spring 301. The movable spring 301 is fastened to a movable spring lock part 106 of the base cover 10. A space having a predetermined distance is maintained between the movable contact 303*a* and the stationary contact 204*a* forming the first contact part 401. A terminal part insulation wall 107 of the base cover 10 is arranged at the X1 side of the first contact part 401 to be interposed between the first contact part 401 and the yoke 24. The space illustrated by dotted lines in FIG. 7 represents an arc extending space 40.

In the following, a magnetic field that is generated between the permanent magnets 23*a* and 23*b* is described with reference to FIGS. 8A and 8B. FIG. 8A illustrates a magnetic field generated in a case where the yoke 24 is not provided, and FIG. 8B illustrates a magnetic field generated in the case where the yoke 24 is provided.

In the example illustrated in FIG. 8A, the permanent magnets 23*a* and 23*b* are arranged to face each other with their N poles directed inward and their S poles directed outward. In this case, magnetic fields are generated at the permanent magnets 23*a* and 23*b* along magnetic field lines extending from the N pole to the S pole as illustrated by arrows in FIG. 8A. A magnetic field in the Y2 direction is generated at the first contact part 401, and a magnetic field in the Y1 direction is generated at the second contact part 402. By arranging the same poles of the permanent magnets 23*a* and 23*b* to face each other, a stronger magnetic field may be generated compared to a case where a magnetic field is generated by a single permanent magnet.

Further, as described above with reference to FIGS. 6A and 6B, in the present embodiment, the permanent magnets 23*a* and 23*b* are extended in the X1 direction. In this way, a strong magnetic field may be generated even at a position distanced away from the first contact part 401 and the second contact part 402 in the X1 direction.

Figure 8B:
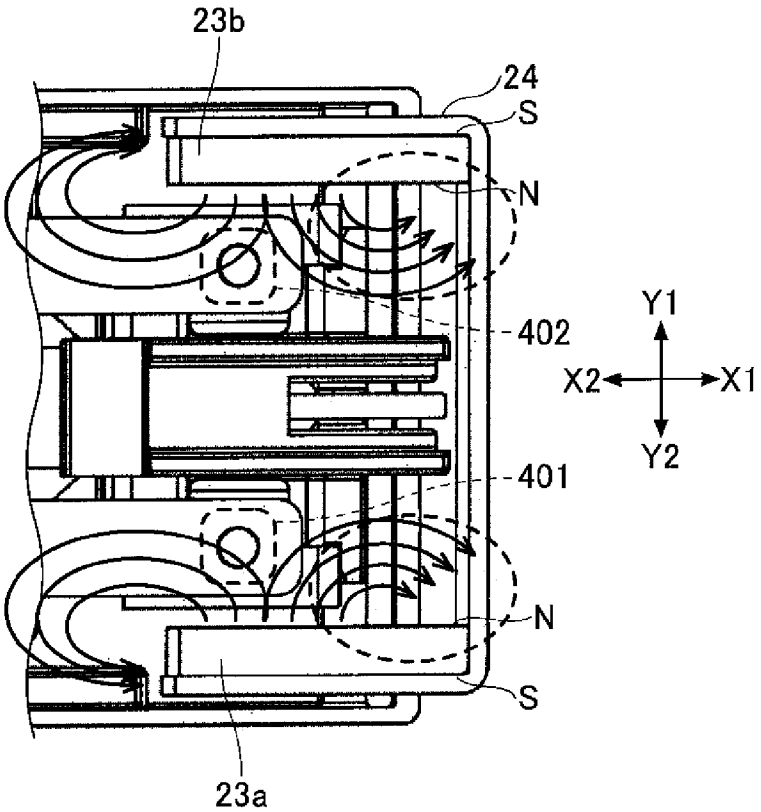
FIG. 8B illustrates a magnetic field generated in a case where the yoke is provided.
Figure 8A:
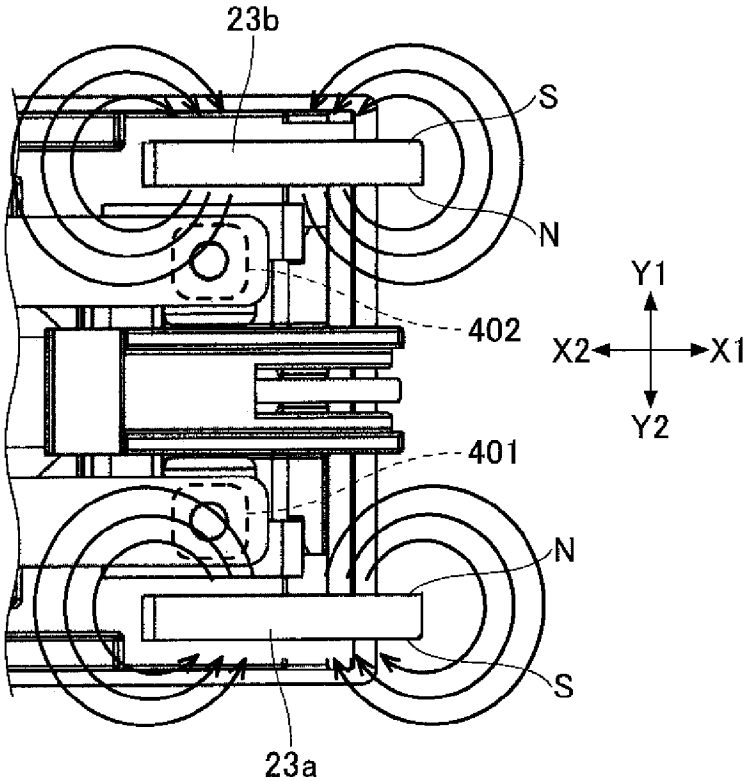
FIG. 8A illustrates a magnetic field generated in a case where the yoke is not provided.

In the example illustrated in FIG. 8B, the yoke 24 is arranged at the outer sides of the permanent magnets 23*a* and 23*b*. By arranging the yoke 24 at the S pole sides of the permanent magnets 23*a* and 23*b*, the density of the magnetic field lines flowing toward the S poles may be increased. The density of the magnetic field lines may be particularly be increased compared to FIG. 8A at portions surrounded by dotted lines in FIG. 8B. That is, by providing the yoke 24, a stronger magnetic field may be generated within the arc extending space 40.

Figure 9B:
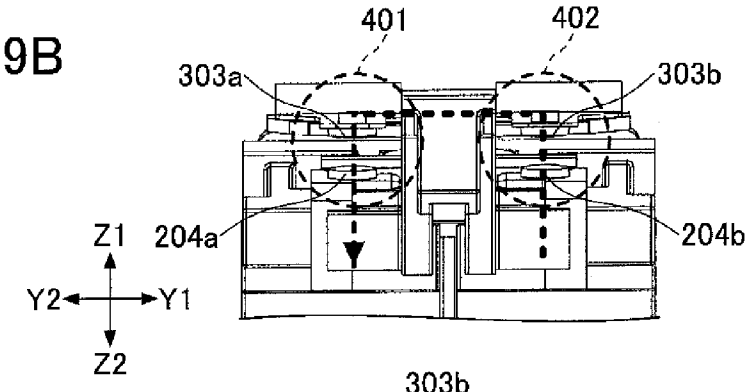
FIGS. 9A-9D are respectively a perspective view, a front view, a right side view, and a left side view of a current path.
Figure 9C:
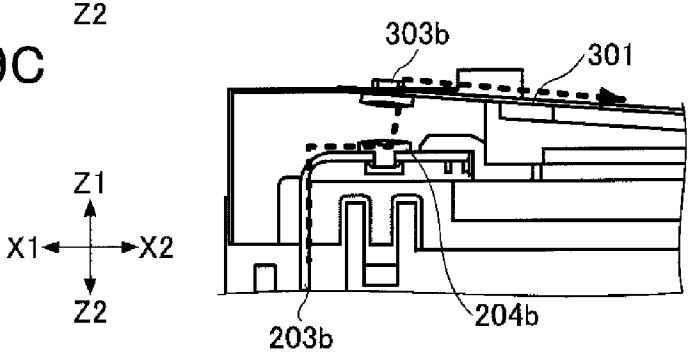
Figure 9D:
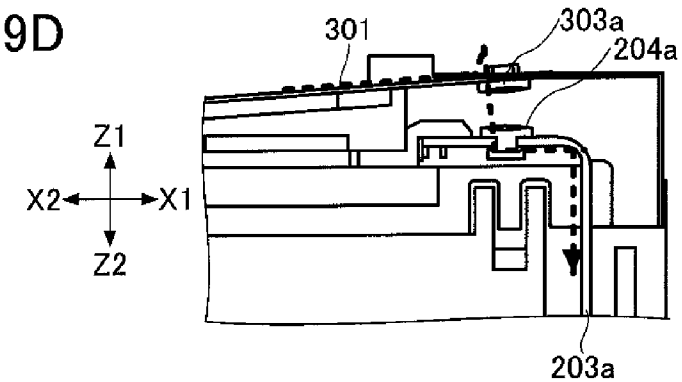
Figure 9A:
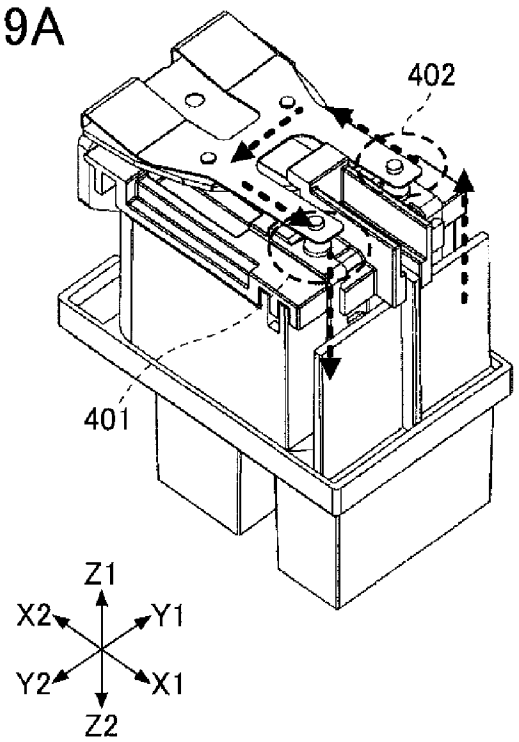

In the following, an exemplary current path of an electrical current that flows through an electrical circuit of the electromagnetic relay 1 is described with reference to FIGS. 9A-9D. FIG. 9A is a perspective view of the current path; FIG. 9B is a front view of the current path; FIG. 9C is a right side view of the current path; and FIG. 9D is a left side view of the current path.

In FIGS. 9A-9D, the current path is illustrated by broken line arrows. Note that although the first contact part 401, which is formed by the stationary contact 204*a* and the movable contact 303*a*, and the second contact part 402, which is formed by the stationary contact 204*b* and the movable contact 303*b*, are left open in the illustrations of FIGS. 9A-9D, an electrical current actually flows through the current path indicated by the broken line arrows when the first contact part 401 and the second contact part 402 are closed. Specifically, when the first contact part 401 and the second contact part 402 are closed, an electrical current is introduced from the movable terminal 203*b*, and flows through the stationary contact 404*b*, the movable contact 303*b*, the movable spring 301, the movable contact 303*a*, the stationary contact 204*a*, and the stationary terminal 203*a*. In other words, the electrical current flows in the Z2 direction at the first contact part 401 and flows in the Z1 direction at the second contact part 402.

In the following, an exemplary manner in which an arc generated by the electrical current illustrated in FIGS. 9A-9D is extended by the magnetic field illustrated in FIGS. 8A-8B is described with reference to FIGS. 10A-10D. FIG. 10A is a perspective view of arcs generated at the first contact part 401 and the second contact part 402; FIG. 10B illustrates when an arc is generated; FIG. 10C illustrates when the arc is extended; and FIG. 10D illustrates a state right before the arc is extinguished. Note that in FIGS. 10A-10D, illustrations of the arc extending space 40 formed by the terminal part insulation wall 107 of the base cover 10 shown in FIG. 7 are omitted for the sake of clearly illustrating how an arc that is generated at a contact part is extended.

FIG. 10A illustrates an exemplary case in which an arc is generated when the first contact part 401 is opened while a load current is flown through the current path. The arc is generated at the space between the stationary contact 204*a* and the movable contact 303*a*, causing the first contact part 401 to heat up and ionizing the surrounding air so that the current continues to flow through the current path. Because an electrical current flows downward in the Z2 direction at the first contact part 401 as described above with reference to FIGS. 9A-9D, the arc generated at the first contact part 401 flows in the Z2 direction. Accordingly, based on Fleming's left-hand rule, the magnetic field in the Y1 direction as described above with reference to FIGS. 8A and 8B causes a force in the X1 direction to act on the arc generated at the first contact part 401. As a result, the arc is extended in the X1 direction. FIG. 10B illustrates when the arc is generated. The arc generated at position A as illustrated in FIG. 10B receives a force in the X1 direction to thereby extend to position B as illustrated in FIG. 10C. FIG. 10D illustrates a state of the arc that is further extended to position C right before the arc is extinguished.

As described above with reference to FIGS. 9A-9D, because an electrical current flows upward in the Z1 direction at the second contact part 402, the arc generated at the space between the stationary contact 204*b* and the movable contact 303*b* flows in the Z1 direction. Accordingly, the magnetic force in the Y2 direction as described above with reference to FIGS. 8A and 8B causes a force in the X1 direction to act on the arc generated at the second contact part 402, and the arc is extended in the X1 direction in a manner similar to the above-described manner in which the arc generated at the first contact part 401 is extended.

Note that the arc extinguishing performance may be improved as the arc extending distance is increased. As described above with reference to FIGS. 8A and 8B, in the present embodiment, the magnetic flux density in the arc extending direction is increased by arranging the same poles of the permanent magnets 23*a* and 23*b* to face each other, arranging the permanent magnets 23*a* and 23*b* to extend in the X1 direction corresponding to the arc extending direction, and further providing the yoke 24. In this way, the force acting to extend the arc may be strengthened so that the arc extending distance may be increased. Also, the extended arc may be more easily extinguished by providing the arc extending space for extending the arc.

In the electromagnetic relay 1 of the present embodiment, the arc extending directions of both the first contact part 401 and the second contact part 402 are arranged in the X1 direction. In this way, the arc extending space 40 (see FIG. 7) for both the first contact part 401 and the second contact part 402 may be arranged to extend in the X1 direction. On the other hand, in a case where the arc extending directions of the first contact part 401 and the second contact part 402 are arranged to be different such that one extends in the X1 direction while the other extends in the X2 direction, for example, an arc extending space extending in the X1 direction and an arc extending space extending in the X2 direction have to be provided. Thus, by arranging the arc extending directions of both the first contact part 401 and the second contact part 402 to extend in the X1 direction, the electromagnetic relay 1 of the present embodiment may be reduced in size in the X1-X2 directions compared to a case where the arc extending directions are arranged to extend in the X1 direction and the X2 direction. Also, the length of the yoke 24 in the X1-X2 directions may be reduced. In this way, the electromagnetic relay 1 of the present embodiment may be reduced in size while improving its insulation.

Note that although two permanent magnets 23*a* and 23*b* that are arranged to face each other are used in the embodiment described above, in other embodiments, the permanent magnet 23*c* illustrated in FIG. 1D may be additionally arranged at the permanent magnet mount part 104*c* illustrated in FIGS. 1B and 1C, for example. In this way, the magnetic flux density may be further increased and the direction of the magnetic field line may be adjusted, for example.

In the following, insulation of the electromagnetic relay 1 is described. Generally, insulation may be evaluated based on a clearance distance and a creepage distance. The clearance distance refers to the shortest distance in air between two conductive parts. Creepage distance refers to the shortest distance along the surface of a solid insulating material between two conductive parts.

[Insulation between Coil Terminal and Stationary Terminal]

Figure 11B:
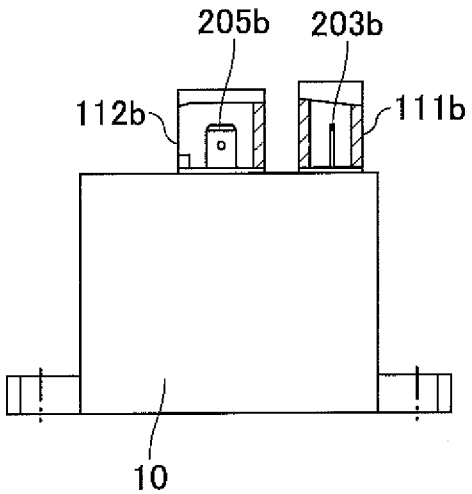
FIGS. 11A and 11B are external views of an exemplary arrangement of coil terminals and stationary terminals.
Figure 11A:
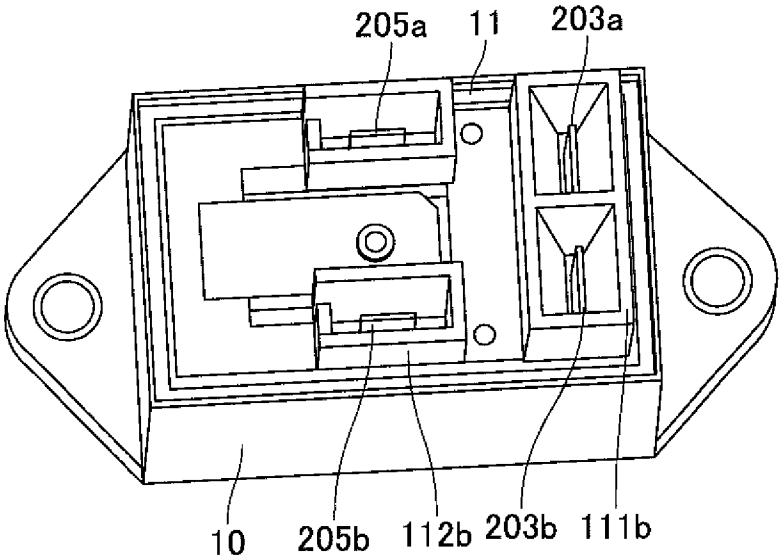
Figure 12:
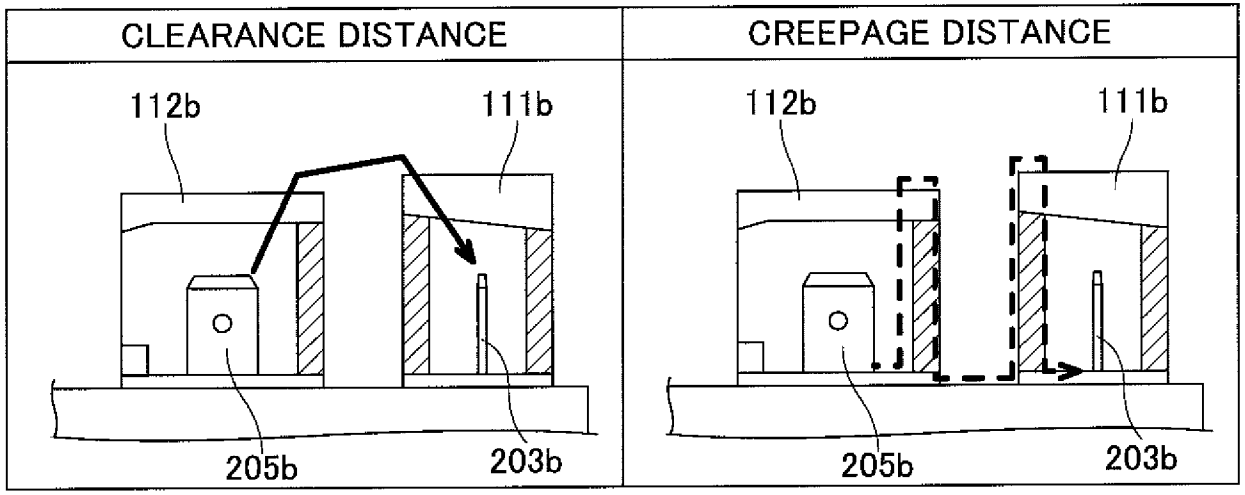
FIG. 12 illustrates cross-sectional views of a clearance distance and a creepage distance between a coil terminal and a stationary terminal.

FIGS. 11A and 11B are external views of an exemplary arrangement of coil terminals and stationary terminals. FIG. 12 includes cross-sectional views illustrating a clearance distance and a creepage distance between the stationary terminal 203*b* and the coil terminal 205*b*.

Referring to FIGS. 11A and 11B, the degree of insulation between the stationary terminal 203*b* and the coil terminal 205*b* may be determined by the shapes and dimensions of the stationary terminal cover 111*b* and the coil terminal cover 112*b*. The stationary terminal cover 111*b* and the coil terminal cover 112*b* are parts of the base cover 11, which is made of insulating plastic material. As described above with reference to FIG. 1A, the stationary terminal cover 111*b* is arranged into a sleeve-shaped structure standing upright in the Z1 direction to surround the stationary terminal 203*b*. The coil terminal cover 112*b* is arranged into a three-sided structure standing upright in the Z1 direction to cover the sides of the coil terminal 205*b* other than the X1 side corresponding to the opposite side of the stationary terminal cover 111*b*.

In FIG. 12, the clearance distance between the stationary terminal 203*b* and the coil terminal 205*b* is illustrated by a solid line arrow. The illustrated clearance distance is the shortest distance in air from the coil terminal 205*b* to the stationary terminal 203*b* via the coil terminal cover 112*b* and the stationary terminal cover 111*b*. The creepage distance between the stationary terminal 203*b* and the coil terminal 205*b* is illustrated by a broken line arrow in FIG. 12. The illustrated creepage distance is the shortest distance along a solid surface from the coil terminal 205*b* and the stationary terminal 203*b* via the coil terminal cover 112*b* and the stationary terminal cover 111*b*. As can be appreciated, the clearance distance and the creepage distance between the stationary terminal 203*b* and the coil terminal 205*b* may be increased by increasing the heights of the stationary terminal cover 111*b* and the coil terminal cover 112*b*. According to an aspect of the present embodiment, by arranging the sleeve-shaped stationary terminal covers 111*a* and 111*b* to cover the stationary terminals 203*a* and 203*b*, the clearance distance and the creepage distance may be increased as described above so that insulation of the stationary terminals 203*a* and 203*b* from the coil terminal 205*a* and 205*b* may be improved, and insulation of the stationary terminals 203*a* and 203*b* from external parts outside the electromagnetic relay 1 may be improved as well.

In the following, insulation between the coil 202 and the electromagnetic yoke 22 is described. Insulation between the coil 202 and the electromagnetic yoke 22 may be determined based on the clearance distances and the creepage distances of first through fourth paths within the electromagnetic relay 1 as described below. Note that when insulation is lower at one of the first though fourth paths compared to the rest of the paths, a short circuit may occur at such path. Accordingly, insulation is preferably arranged to be substantially the same at the first through fourth paths.

[Insulation between Coil and Electromagnetic Yoke at First Path]

Figure 13A:
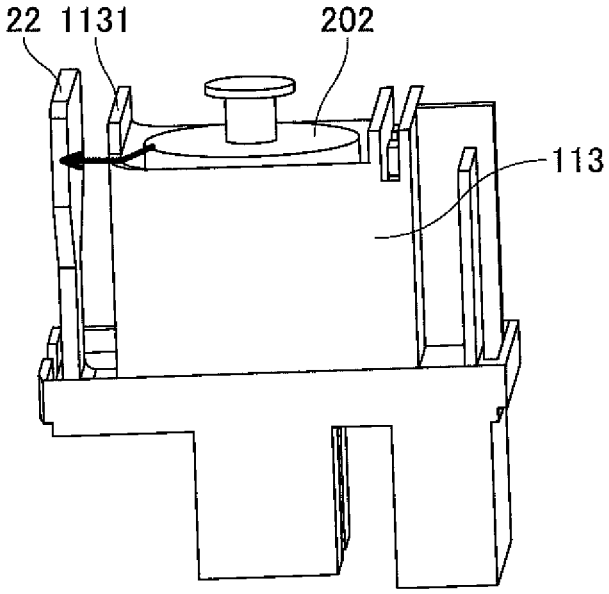
FIGS. 13A and 13B are respectively a perspective side view and a top view illustrating a clearance distance of a first path between the coil and an electromagnetic yoke.
Figure 13B:
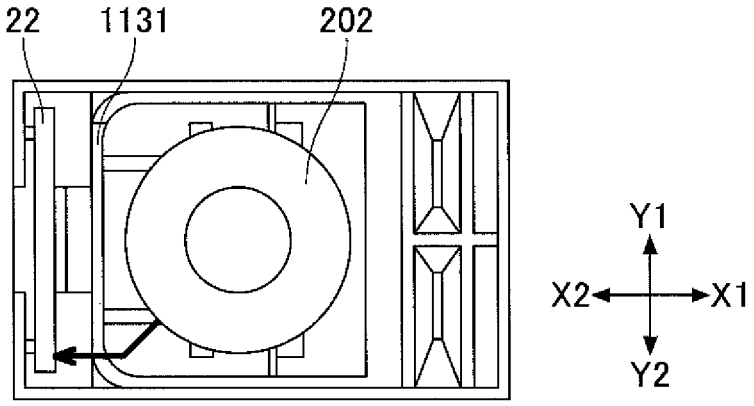
Figure 14A:
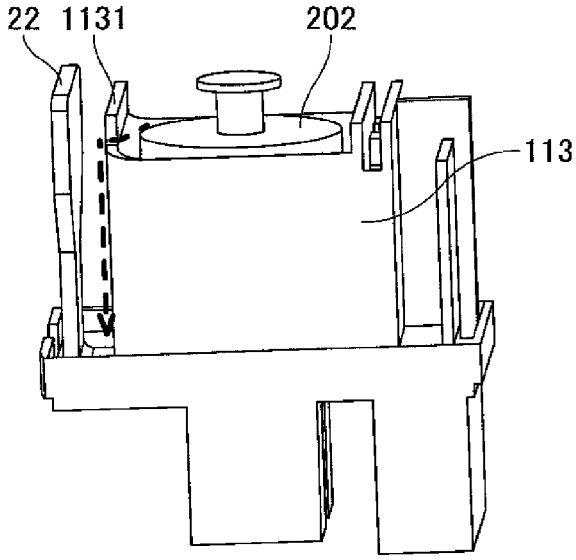
FIGS. 14A-14C are respectively a perspective side view, a top view, and a perspective view illustrating a creepage distance of the first path between the coil and the electromagnetic yoke.
Figure 14B:
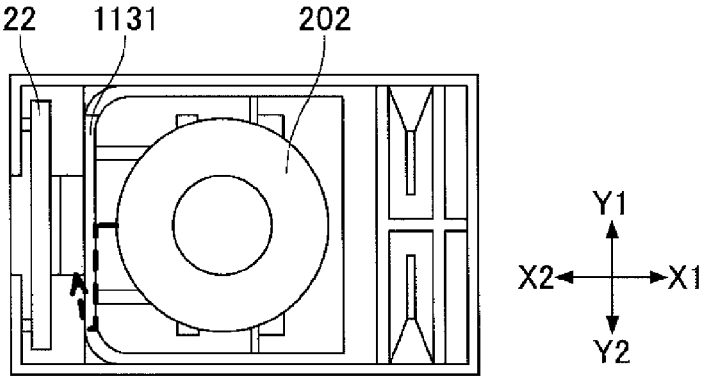
Figure 14C:
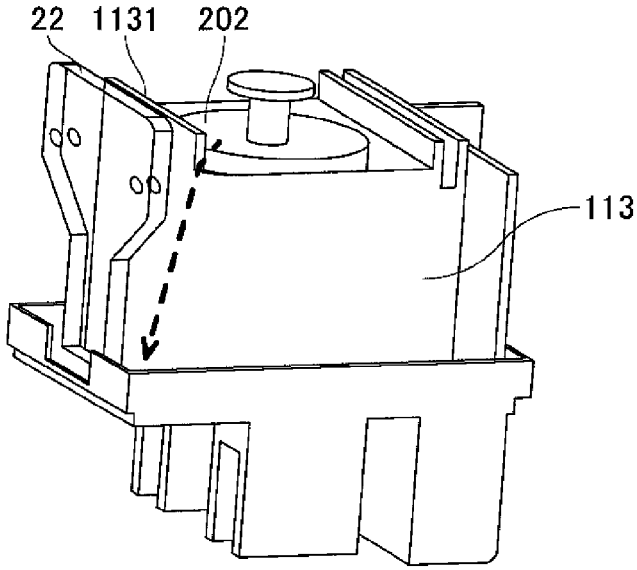

The first path, which is illustrated by arrows in FIGS. 13A-14C, corresponds to a path from the coil 202 to the electromagnetic yoke 22 that passes a Y1-Y2 direction lateral side of the barrier 1131, which is arranged at the opening of the coil accommodating part 113. FIGS. 13A and 13B are respectively a perspective side view and a top view illustrating a clearance distance of the first path between the coil 202 and the electromagnetic yoke 22. FIGS. 14A-14C are respectively a perspective side view, a top view, and a perspective view illustrating a creepage distance of the first path between the coil 202 and the electromagnetic yoke 22.

In FIGS. 13A and 13B, the clearance distance of the first path between the coil 202 and the electromagnetic yoke 22 is illustrated by solid line arrows. The coil 202 is accommodated within the coil accommodating part 113. The barrier 1131, which is described above with reference to FIG. 3, is arranged at the electromagnetic yoke 22 side of the coil accommodating part 113. As illustrated in FIG. 13A, the shortest distance in air from the coil 202 to the electromagnetic yoke 22 is along a path extending from the coil 202 that passes an edge of the barrier 1131 to reach an upper part of the electromagnetic yoke 22. According to an aspect of the present embodiment, by arranging the barrier 1131 at the coil accommodating part 113, the clearance distance of the first path may be increased to thereby improve insulation between the coil 202 and the electromagnetic yoke 22 at the first path.

In FIGS. 14A-14C, the creepage distance of the first path between the coil 202 and the electromagnetic yoke 22 is illustrated by broken line arrows. The illustrated creepage distance of the first path extends from the coil 202, passes an edge of the barrier 1131, and runs along the outer surface of the coil accommodating part 113 to reach a bent portion of the electromagnetic yoke 22 that extends horizontally as illustrated in FIG. 4. As illustrated in FIG. 14B, by arranging the barrier 1131 at the coil accommodating part 113, the creepage distance of the first path may be increased in the X2 direction to thereby improve insulation between the coil 202 and the electromagnetic yoke 22 at the first path.

[Insulation between Coil and Electromagnetic Yoke at Second Path]

Figure 15:
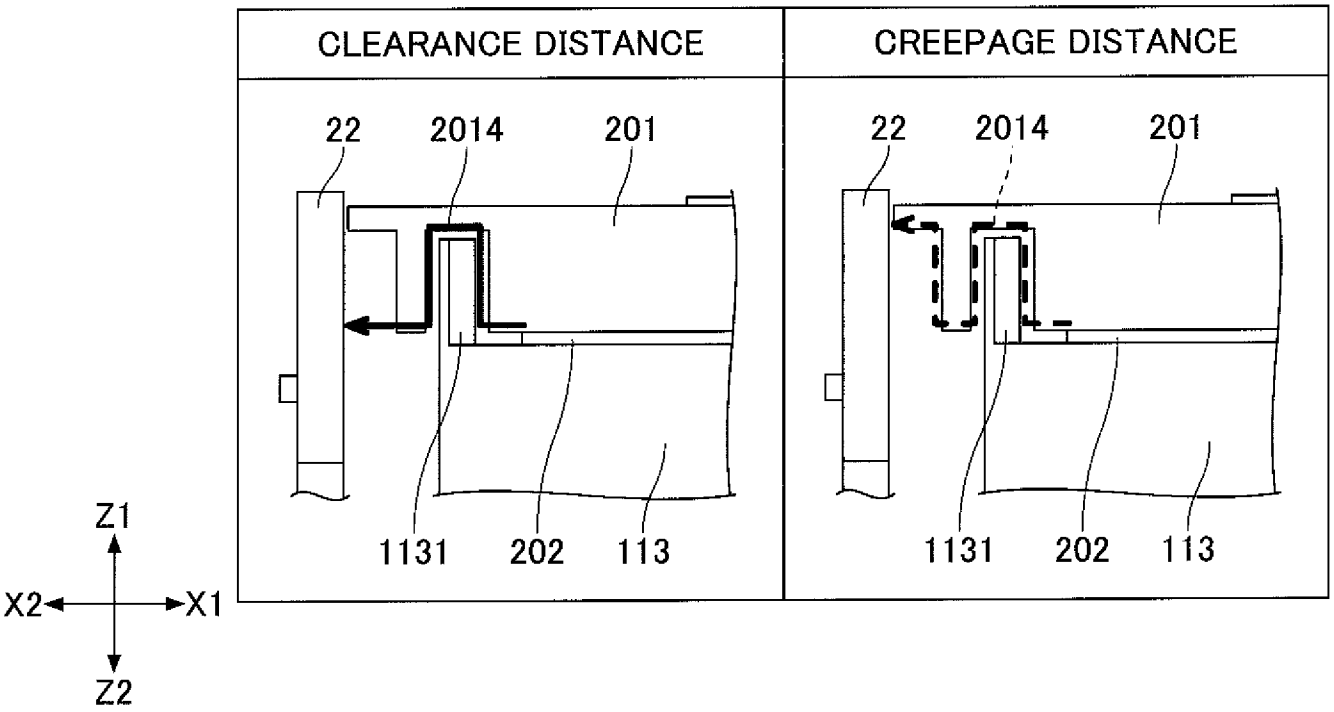
FIG. 15 illustrates a clearance distance and a creepage distance of a second path between the coil and the electromagnetic yoke.

The second path, which is illustrated by arrows in FIG. 15, corresponds to a path from the coil 202 to the electromagnetic yoke 22 that extends across the barrier 1131 when the barrier 1131 of the coil accommodating part 113 and the labyrinth 2014 of the bobbin 201 are engaged as described above with reference to FIG. 3. FIG. 15 illustrates a clearance distance and a creepage distance of the second path between the coil 202 and the electromagnetic yoke 22.

In FIG. 15, the clearance distance between the coil 202 and the electromagnetic yoke 22 is illustrated by a solid line arrow, and the creepage distance between the coil 202 and the electromagnetic yoke 22 is illustrated by a broken line arrow. A convex portion of the barrier 1131 engages a concave portion of the labyrinth 2014 to form a concave-convex structure. The clearance distance of the second path extends from an upper portion of the coil 202 toward the electromagnetic yoke 22 via a portion of the concave-convex structure formed by the engagement of labyrinth 2014 and the barrier 1131. The creepage distance of the second path extends along the surface of the labyrinth 2014. As can be appreciated, by arranging the labyrinth 2014 having the concave-convex structure in the Z1-Z2 directions, the clearance distance and the creepage distance of the second path may be increased to thereby improve insulation between the coil 202 and the electromagnetic yoke 22 at the second path.

Note that in FIG. 15, the space between the labyrinth 2014 and the barrier 1131 is not drawn to scale. That is, although the space between the labyrinth 2014 and the barrier 1131 is enlarged in FIG. 15 for the sake of clearly describing the clearance distance and the creepage distance, the labyrinth 2014 and the barrier 1131 may actually be held close together upon being engaged. Note, however, that aspects of the present embodiment are directed to increasing the clearance distance and the creepage distance between the coil 202 and the electromagnetic yoke 22 by means of the concave-convex structure formed by the labyrinth 2014 and the barrier 1131 rather than obtaining a tight seal between the labyrinth 2014 and the barrier 1131. Accordingly, the labyrinth 2014 and the barrier 1131 may be tightly engaged or loosely engaged in the present embodiment. That is, the strength of engagement between the labyrinth 2014 and the barrier 1131 is not particularly limited in the present embodiment.

[Insulation between Coil and Electromagnetic Yoke at Third Path]

Figure 16:
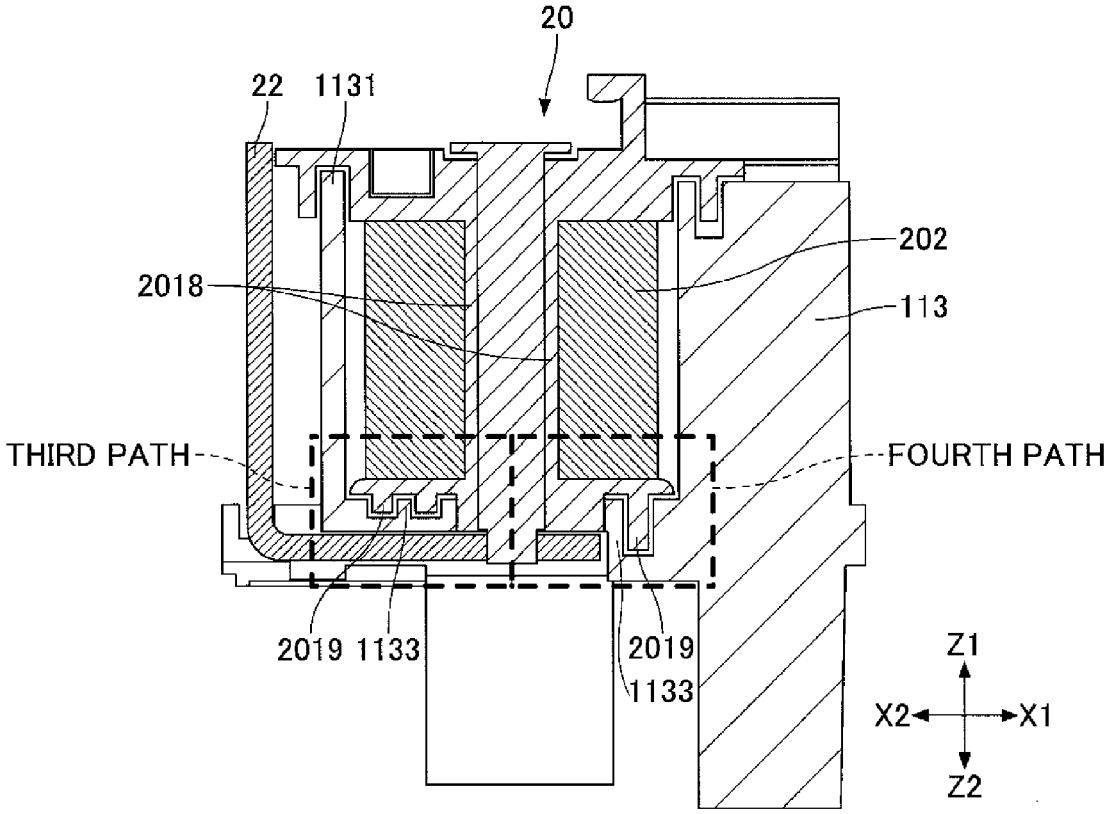
FIG. 16 is a cross-sectional view of a coil accommodating part and the coil bobbin assembly that are assembled together.
Figure 17:
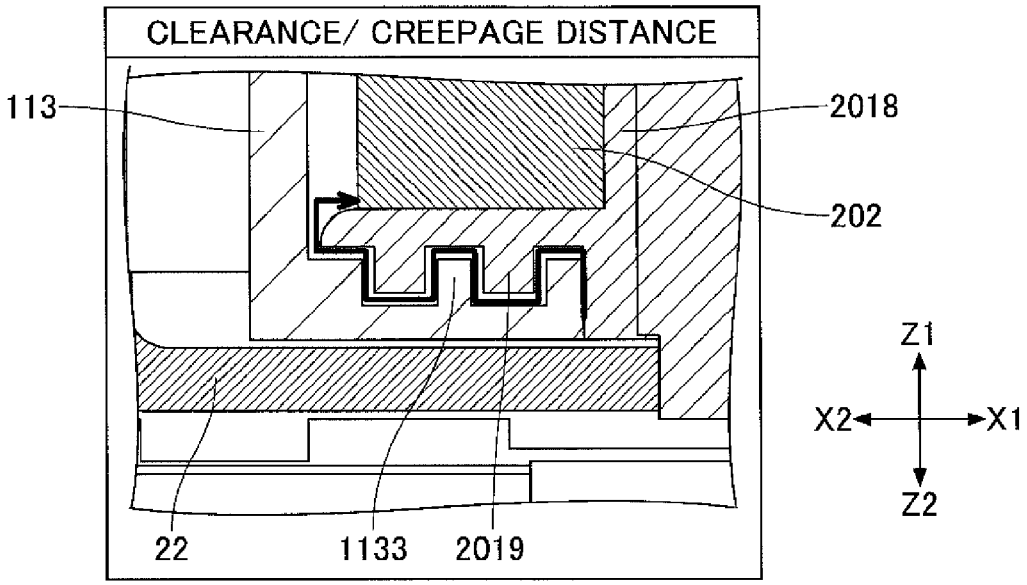
FIG. 17 is an enlarged partial view of a lower left side portion of the structure illustrated in FIG. 16.

FIG. 16 is a cross-sectional view of the coil accommodating part 113 and the coil bobbin assembly 20 that are assembled together. FIG. 17 is an enlarged partial view of a lower left side portion of the structure illustrated in FIG. 16.

In FIG. 17, a clearance distance and a creepage distance of the third path between the coil 202 and the electromagnetic yoke 22 is represented by a solid line arrow. As illustrated in FIG. 17, the third path extends from a bottom portion of the electromagnetic yoke 22 to a X2 direction side end portion at the bottom of the coil 202 via a concave-convex structure formed by the labyrinth 1133 of the coil accommodating part 113 and the labyrinth 2019 of the bobbin 201 that are engaged together. As described above with reference to FIG. 3, the labyrinth 1133 includes grooves extending in the Y1-Y2 directions at the bottom of the coil accommodating part 113. The labyrinth 2019 is arranged at the bottom of the bobbin 201 where the coil 202 is wound around a coil winding part 2018. The labyrinth 2019 is arranged into a suitable shape for engaging the grooves of the labyrinth 1133. By engaging the labyrinth 1133 and the labyrinth 2019 together to form a concave-convex structure in the Z1-Z2 directions, the clearance distance and the creepage distance of the third path between the coil 202 and the electromagnetic yoke 22 may be increased to thereby improve insulation between the coil 202 and the electromagnetic yoke 22 at the third path.

[Insulation between Coil and Electromagnetic Yoke at Fourth Path]

Figure 18:
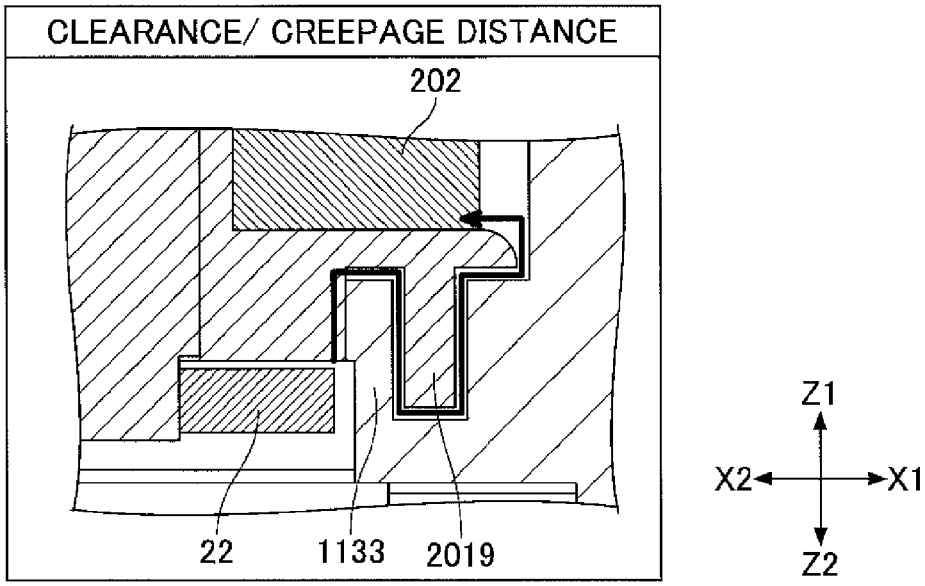
FIG. 18 is an enlarged partial view of a lower right side portion of the structure illustrated in FIG. 16.

FIG. 18 is an enlarged partial view of a lower right side portion of the structure illustrated in FIG. 16. In FIG. 18, a clearance distance and a creepage distance of the fourth path between the coil 202 and the electromagnetic yoke 22 is represented by a solid line arrow. As illustrated in FIG. 18, the clearance distance and the creepage distance of the fourth path extends from a bottom portion of the electromagnetic yoke 22 to an X1 direction side end portion of the bottom of the coil 202 via a concave-convex structure formed by the labyrinth 1133 of the coil accommodating part 113 and the labyrinth 2019 of the bobbin 201 that are engaged together. The third path and the fourth path have different path configurations because the electromagnetic yoke 22 is inserted at the bottom of the of the coil accommodating part 113 from the X2 side to the X1 side, and as a result, the shapes of the coil accommodating part 113 and the bobbin 201 are not symmetrical with respect to the X1-X2 directions. The labyrinth height at the fourth path is arranged to be higher than the labyrinth height of the third path. The clearance distance and the creepage distance of the fourth path may be adjusted so that insulation at the fourth path may be substantially the same as the insulation at the third path.

[Insulation between Coil and Stationary Terminal]

Figure 19:
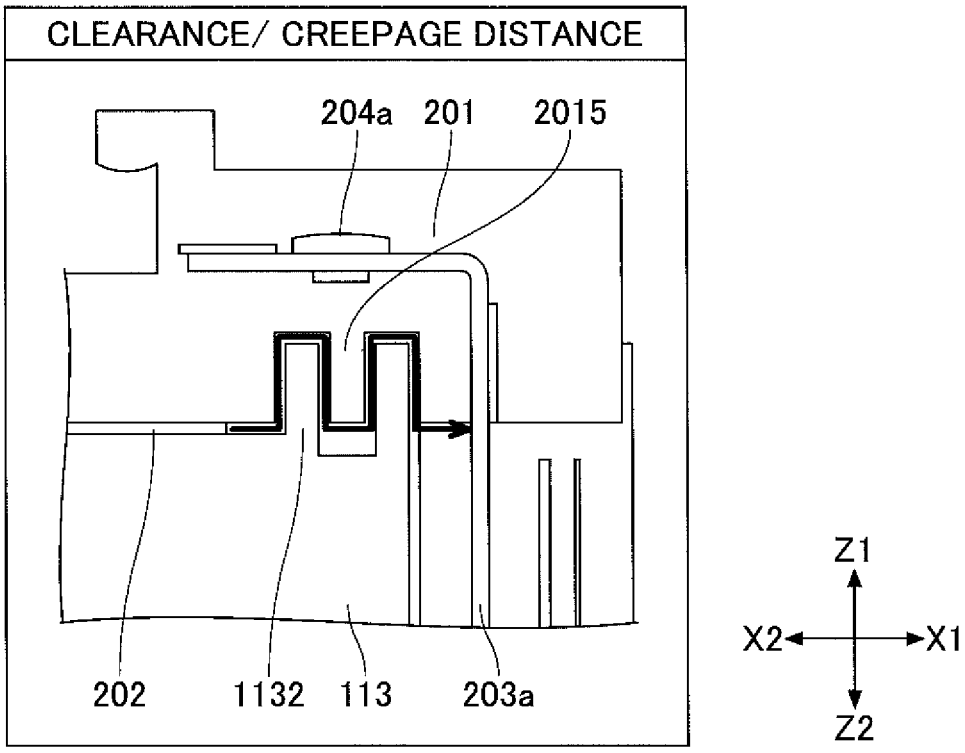
FIG. 19 illustrates a clearance distance and a creepage distance between the coil 202 and the stationary terminal.

In the following, insulation between the coil 202 and the stationary terminal 203*a*/203*b* is described with reference to FIG. 19. FIG. 19 illustrates a clearance distance and a creepage distance between the coil 202 and the stationary terminal 203*a*.

In FIG. 19, the clearance distance and the creepage distance between the coil 202 and the stationary terminal 203*a* are represented by a solid line arrow. The coil 202 is accommodated within the coil accommodating part 113. As described above with reference to FIG. 3, the labyrinth 1132 is arranged at the X1 direction side portion of the opening of the coil accommodating part 113. The stationary terminal 203*a* having the stationary contact 204*a* attached thereto is press fit to the bobbin 201. Also, the labyrinth 2015 is arranged at the bobbin 201, and when the coil accommodating part 113 and the bobbin 201 are assembled together, the labyrinth 1132 engages the labyrinth 2015 to form a concave-convex structure. According to an aspect of the present embodiment, by arranging the labyrinth 1132 and the labyrinth 2015 to form such a concave-convex structure, the clearance distance and the creepage distance between the coil 202 and the stationary terminal 203*a* may be increased so that insulation between the coil 202 and the stationary terminal 203*a* may be improved.

[Insulation between Coil and Core]

Figure 20A:
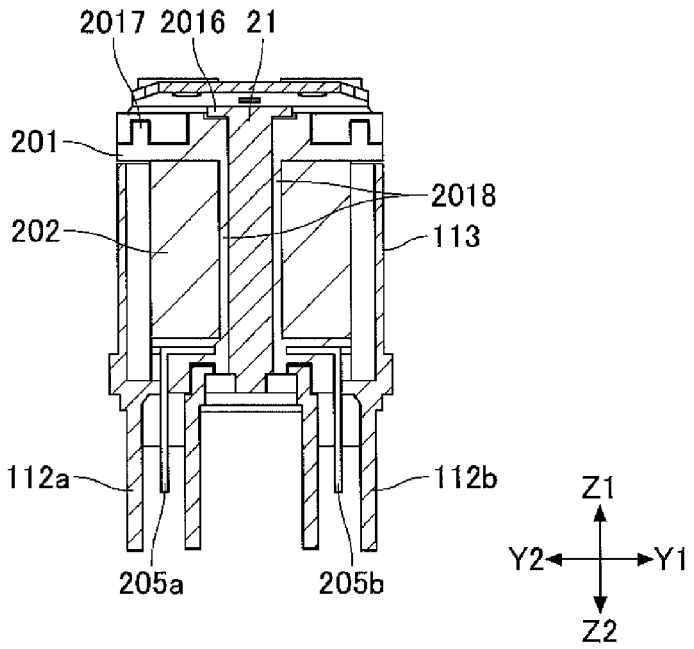
FIG. 20A is a cross-sectional view illustrating insulation between the coil and a core.

In the following, insulation between the coil 202 and the core 21 is described with reference to FIGS. 20A and 20B. FIG. 20A is a cross-sectional view illustrating the insulation between the coil 202 and the core 21; and FIG. 20B includes enlarged partial views illustrating a clearance distance and a creepage distance between the coil 202 and the core 21.

In FIG. 20A, the coil 202 that is wound around the coil winding part 2018 of the bobbin 201 is accommodated within the coil accommodating part 113. The coil terminals 205*a* and 205*b* are attached to the coil 202, and the coil terminals 205*a* and 205*b* are covered by the coil terminal covers 112*a* and 112*b*, respectively. The upper part of the bobbin 201 flares out in the Y1-Y2 directions and comes into contact with the coil accommodating part 113. The labyrinth 2017 is arranged at the upper face of the bobbin 201. The core 21 is mounted to the core mount part 2016 of the bobbin 201.

Figure 20B:
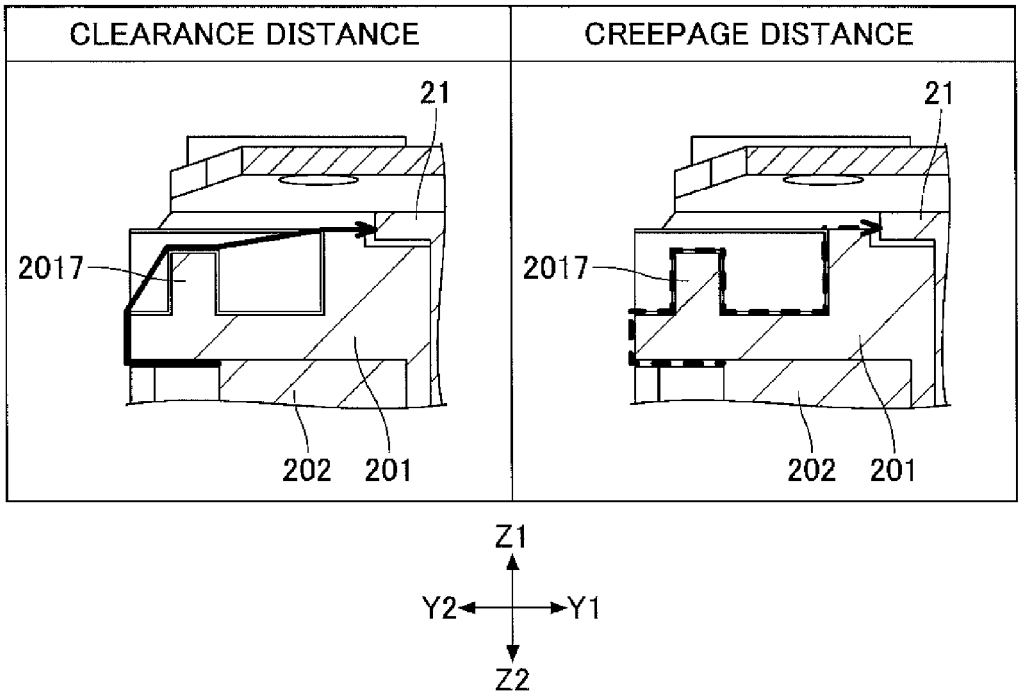
FIG. 20B illustrates enlarged partial views of a clearance distance and a creepage distance between the coil and the core.

FIG. 20B illustrates the upper left portion of the structure illustrated in FIG. 20A. In FIG. 20B, the clearance distance between the coil 202 and the core 21 is illustrated by a solid line arrow. The illustrated clearance distance is the shortest distance in air from the coil 202 to the core 21 along a path that extends from an upper portion of the coil 202 and passes a Y2 side flared portion of the bobbin 201 and the labyrinth 2017 to reach the core 21. According to an aspect of the present embodiment, the clearance distance between the coil 202 and the core 21 may be increased by the flared portion of the bobbin 201 extending outward in the Y2 direction and the height of the labyrinth in the Z1 direction so that insulation between the coil 202 and the core 21 may be improved.

The creepage distance between the coil 202 and the core 21 is illustrated by a broken line arrow in FIG. 20B. The illustrated creepage distance is the shortest distance between the coil 202 and the core 21 along a path running across the surfaces of the upper portion of the coil 202, the flared portion of the bobbin 201 extending in the Y2 direction, and the labyrinth 2017 to reach the core 21. According to an aspect of the present embodiment, the creepage distance between the coil 202 and the core 21 may similarly be increased by the flared portion of the bobbin 201 extending outward in the Y2 direction and the height of the labyrinth in the Z1 direction so that insulation between the coil 202 and the core 21 may be improved.

[Insulation between Stationary Terminals]

Figure 21A:
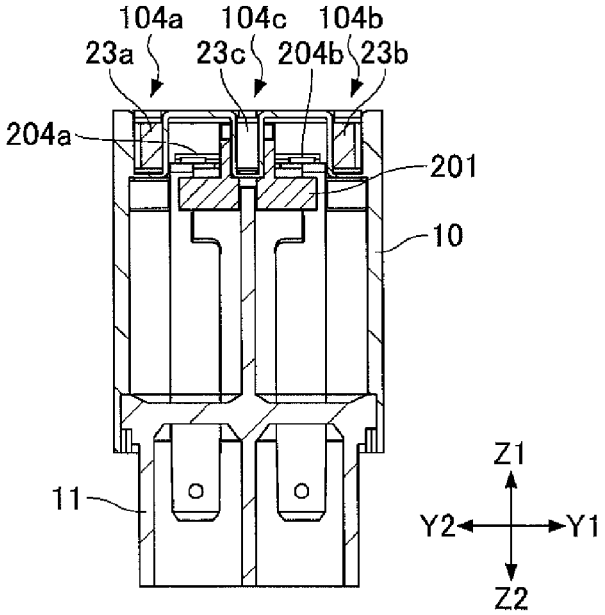
FIG. 21A is a cross-sectional view illustrating insulation between the stationary terminals.

In the following, insulation between the stationary terminals 203*a* and 203*b* is described with reference to FIGS. 21A and 21B. FIG. 21A is a cross-sectional view illustrating the insulation between the stationary terminals 203*a* and 203*b*; and FIG. 21B includes enlarged partial views illustrating a clearance distance and a creepage distance between the stationary terminals 203*a* and 203*b*.

In FIG. 21A, the stationary contacts 204*a* and 204*b* are attached to the stationary terminals 203*a* and 203*b*, respectively, and are covered by the base cover 10. As described above with reference to FIG. 5, the permanent magnet mount parts 104*a*-104*c* are concave portions that are arranged at the mount surface 103 of the base cover 10. The permanent magnet mount parts 104*a*-104*c* are configured to have the permanent magnets 23*a*-23*c* respectively mounted therein. In the present embodiment, the permanent magnet mount parts 104*a*-104*c* form convex portions as viewed from the Z2 direction side of the mount surface 103 corresponding to the rear face side of the mount surface 103. The bobbin 201 includes the inter-stator insulation walls 2013*a* and 2013*b*. A concave portion is formed between the inter-stator insulation walls 2013*a* and 2013*b*. When the base cover 10 is mounted to the base 11, the convex portion formed by the permanent magnet mount part 104*c* engages the convex portion formed by the inter-stator insulation walls 2013*a* and 2013*b* to create an insulation barrier between the stationary terminals 203*a* and 203*b*.

Figure 21B:
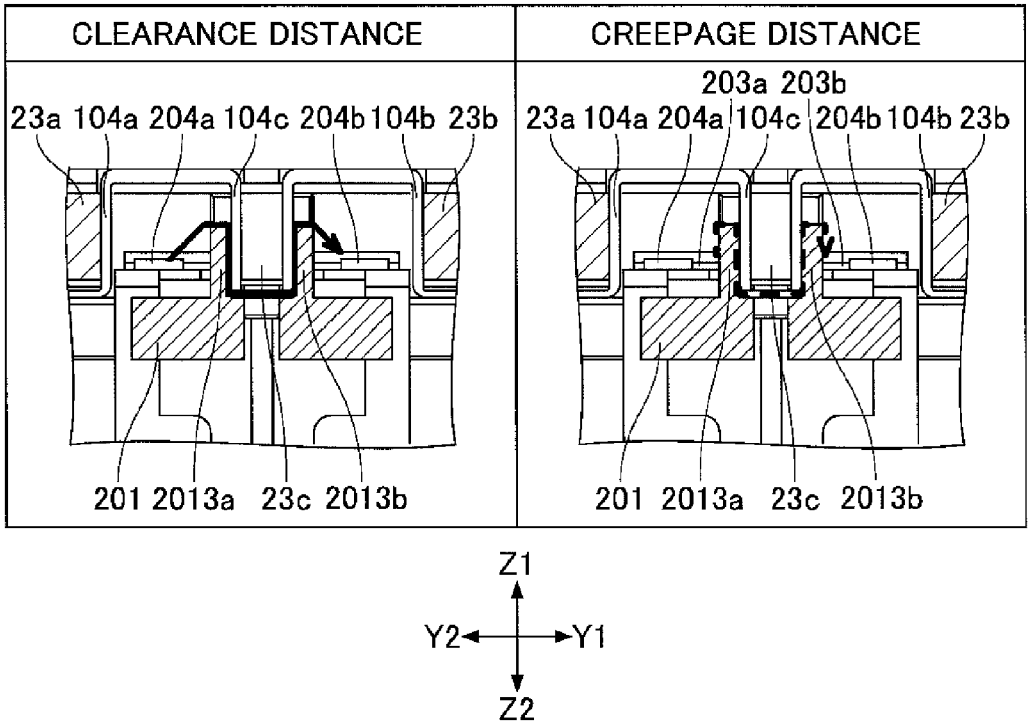
FIG. 21B illustrates enlarged partial views of a clearance distance and a creepage distance between the stationary terminals.

FIG. 21B illustrates an upper portion of the structure illustrated in FIG. 21A. In FIG. 21B, the clearance distance between the stationary terminals 203*a* and 203*b* is illustrated by a solid line arrow. The illustrated clearance distance extends along a path that runs from the stationary contact 204*a* and passes the concave-convex structure formed by the inter-stator insulation walls 2013*a* and 2013*b* and the permanent magnet mount part 104*c* to reach the stationary contact 204*b*. According to an aspect of the present embodiment, the clearance distance may be increased by the concave-convex structure formed by the inter-stator insulation walls 2013*a* and 2013*b* and the permanent magnet mount part 104*c* so that insulation between the stationary terminals 203*a* and 203*b* may be improved.

The creepage distance between the stationary terminals 203*a* and 203*b* is illustrated by a broken line arrow in FIG. 21B. The illustrated creepage distance extends along a path the runs from the stationary terminal 203*a* and passes the concave-convex structure formed by the inter-stator insulation walls 2013*a* and 2013*b* and the permanent magnet mount part 104*c* to reach the stationary terminal 203*b*. According to an aspect of the present embodiment, the creepage distance may be increased by the concave-convex structure formed by the inter-stator insulation walls 2013*a* and 2013*b* and the permanent magnet mount part 104*c* so that insulation between the stationary terminals 203*a* and 203*b* may be improved.

Note that in the above-described embodiment, the concave-convex structure for increasing the clearance/creepage distance is formed by engaging the convex portion formed by the permanent magnet mount part 104*c* of the base cover 10 into the concave portion formed by the inter-stator insulation walls 2013*a* and 2013*b*. However, in one alternative embodiment, a convex portion may be formed by the inter-stator insulation walls 2013*a* and 2013*b*, and a concave portion may be arranged at the base cover 10. In this case, the convex portion formed by the inter-stator insulation walls 2013*a* and 2013*b* may engage the concave portion of the base cover 10 to form a concave-convex structure.

Although certain embodiments of the present invention have been described above, the present invention is not limited to these embodiments but encompasses numerous other variations and modifications that may be made without departing from the scope of the present invention.

The present application is based on and claims the benefit of priority to Japanese Patent Application No. 2012-268860 filed on Dec. 7, 2012, the entire contents of which are hereby incorporated by reference.

What is claimed is:

1. An electromagnetic relay comprising:

a first stationary contact;

a second stationary contact that is aligned with the first stationary contact in a first direction;

a first movable contact that faces the first stationary contact and is configured to be movable toward and away from the first stationary contact in a second direction substantially perpendicular to the first direction, the first stationary contact and the first movable contact forming a first contact part;

a second movable contact that faces the second stationary contact and is configured to be movable toward and away from the second stationary contact in the second direction, the second stationary contact and the second movable contact forming a second contact part;

a first permanent magnet;

a second permanent magnet that faces the first permanent magnet;

a first permanent magnet mount part to which the first permanent magnet is mounted; and a second permanent magnet mount part to which the second permanent magnet is mounted;

wherein the first contact part and the second contact part are interposed between the first permanent magnet and the second permanent magnet with respect to the first direction; and wherein the first permanent magnet mount part and the second permanent mount part are insulated from the first contact part and the second contact part.

2. The electromagnetic relay as claimed in claim 1, further comprising:

a magnetic body that includes a first side, which comes into contact with the first permanent magnet, and a second side, which comes into contact with the second permanent magnet and faces the first side;

wherein the first permanent magnet and the second permanent magnet are interposed between the first side and the second side.

3. The electromagnetic relay as claimed in claim 1, further comprising:

a third permanent magnet mount part to which a third permanent magnet is mounted;

wherein the third permanent magnet mount part is interposed between the first contact part and the second contact part.

4. An electromagnetic relay comprising:

a stationary contact;

a movable contact that faces the stationary contact;

an electromagnet that includes a coil that generates an electromagnetic force, and a bobbin to which the coil is wound; and a coil accommodating part in which the coil is arranged, wherein the bobbin and the coil accommodating part include engagement portions that form a concave-convex structure upon being engaged to each other.

5. The electromagnetic relay as claimed in claim 4, further comprising:

a yoke that is arranged outside the coil accommodating part.

6. The electromagnetic relay as claimed in claim 4, further comprising:

a core that is arranged at a center portion of the coil; and a core mount part to which the core is mounted;

wherein the bobbin includes a coil winding part to which the coil is wound;

and a concave-convex structure is arranged between the coil winding part and the core mount part.

7. The electromagnetic relay as claimed in claim 4, further comprising:

an accommodating part in which the electromagnet is arranged; and a cover that is configured to cover the electromagnetic relay;

wherein the accommodating part includes a concave-convex structure.

8. The electromagnetic relay as claimed in claim 7, wherein the concave-convex structure is formed at a portion of the accommodating part that comes into engagement with the other element of the electromagnetic relay.

9. The electromagnetic relay as claimed in claim 7, further comprising:

a first stationary contact;

a second stationary contact that is aligned with the first stationary contact; and a first engagement portion that is arranged between the stationary contact and the second stationary contact;

wherein the cover includes a second engagement portion that engages with the first engagement portion.

10. The electromagnetic relay as claimed in claim 9, wherein the first engagement portion includes a first wall that is arranged between the first stationary contact and the second stationary contact;

a second wall that is arranged between the first stationary contact and the second stationary contact; and a concave portion that is formed between the first wall and the second wall;

wherein the second engagement portion includes a convex portion that is configured to engage the concave portion.

11. An electromagnetic relay comprising:

a first stationary contact;

a second stationary contact that is aligned with the first stationary contact in a first direction;

a first movable contact that faces the first stationary contact and is configured to be movable toward and away from the first stationary contact in a second direction substantially perpendicular to the first direction, the first stationary contact and the first movable contact forming a first contact part;

a second movable contact that faces the second stationary contact and is configured to be movable toward and away from the second stationary contact in the second direction, the second stationary contact and the second movable contact forming a second contact part;

a first permanent magnet;

a second permanent magnet; and a third permanent magnet;

wherein the first contact part and the second contact part are interposed between the first permanent magnet and the second permanent magnet with respect to the first direction; and the third permanent magnet is interposed between the first contact part and the second contact part.

* * * * *